US009988734B2

(12) United States Patent
Feng et al.

(10) Patent No.: US 9,988,734 B2
(45) Date of Patent: Jun. 5, 2018

(54) LIPSEALS AND CONTACT ELEMENTS FOR SEMICONDUCTOR ELECTROPLATING APPARATUSES

(71) Applicant: Novellus Systems, Inc., Fremont, CA (US)

(72) Inventors: Jingbin Feng, Lake Oswego, OR (US); Robert Marshall Stowell, Wilsonville, OR (US); Shantinath Ghongadi, Tigard, OR (US); Ashwin Ramesh, Beaverton, OR (US)

(73) Assignee: Lam Research Corporation, Fremont, CA (US)

( * ) Notice: Subject to any disclaimer, the term of this patent is extended or adjusted under 35 U.S.C. 154(b) by 87 days.

(21) Appl. No.: 14/685,526

(22) Filed: Apr. 13, 2015

(65) Prior Publication Data

US 2015/0218726 A1 Aug. 6, 2015

Related U.S. Application Data

(63) Continuation-in-part of application No. 13/584,343, filed on Aug. 13, 2012, now Pat. No. 9,228,270.
(Continued)

(51) Int. Cl.
*C25D 17/06* (2006.01)
*C25D 17/00* (2006.01)
*C25D 7/12* (2006.01)

(52) U.S. Cl.
CPC ..... *C25D 17/06* (2013.01); *C25D 17/001* (2013.01); *C25D 17/004* (2013.01);
(Continued)

(58) Field of Classification Search
CPC ..... C25D 7/12–7/126; C25D 17/001; C25D 17/06
See application file for complete search history.

(56) References Cited

U.S. PATENT DOCUMENTS 2,773,257 A 12/1956 Craggs et al.
3,225,899 A 12/1965 Lo Presti et al.
(Continued)

FOREIGN PATENT DOCUMENTS

CN 1550033 A 11/2004
CN 1623012 A 6/2005
(Continued)

OTHER PUBLICATIONS

U.S. Appl. No. 13/563,619, titled "Automated Cleaning of Wafer Plating Assembly," filed Jul. 31, 2012.
(Continued)

*Primary Examiner* — Luan V Van
*Assistant Examiner* — Alexander W Keeling
(74) *Attorney, Agent, or Firm* — Weaver Austin Villeneuve & Sampson LLP

(57) ABSTRACT

Disclosed are cup assemblies for holding, sealing, and providing electrical power to a semiconductor substrate during electroplating which may include a cup bottom element having a main body portion and a moment arm, an elastomeric sealing element disposed on the moment arm, and an electrical contact element disposed on the elastomeric sealing element. The main body portion may be such that it does not substantially flex when a substrate is pressed against the moment arm, and it may be rigidly affixed to another feature of the cup structure. The ratio of the average vertical thickness of the main body portion to that of the moment arm may be greater than about 5. The electrical contact element may have a substantially flat but flexible contact portion disposed upon a substantially horizontal portion of the sealing element. The elastomeric sealing element may be integrated with the cup bottom element during manufacturing.

22 Claims, 9 Drawing Sheets

Related U.S. Application Data

(60) Provisional application No. 61/523,800, filed on Aug. 15, 2011, provisional application No. 62/085,171, filed on Nov. 26, 2014.

(52) U.S. Cl.
CPC ..... *C25D 17/005* (2013.01); *C25D 7/123* (2013.01); *Y10T 29/49778* (2015.01)

(56) References Cited

U.S. PATENT DOCUMENTS 3,430,055 A 2/1969 Metzger
3,684,633 A 8/1972 Haase
3,716,765 A 2/1973 Rueffer et al.
3,724,471 A 4/1973 Sitges
4,418,432 A 12/1983 Vidal
4,466,864 A 8/1984 Bacon et al.
4,569,695 A 2/1986 Yamashita et al.
4,654,235 A 3/1987 Effenberger et al.
4,924,891 A 5/1990 Soubrier et al.
5,000,827 A 3/1991 Schuster et al.
5,221,449 A 6/1993 Colgan et al.
5,227,041 A 7/1993 Brogden et al.
5,281,485 A 1/1994 Colgan et al.
5,289,639 A 3/1994 Bard et al.
5,311,634 A 5/1994 Andros
5,482,611 A 1/1996 Helmer et al.
5,519,945 A 5/1996 Ahvenniemi et al.
5,723,028 A 3/1998 Poris
5,853,559 A 12/1998 Tamaki et al.
5,860,361 A 1/1999 Nanjyo et al.
5,985,762 A 11/1999 Geffken et al.
6,071,388 A 6/2000 Uzoh
6,074,544 A 6/2000 Reid et al.
6,080,291 A 6/2000 Woodruff et al.
6,099,702 A 8/2000 Reid et al.
6,108,847 A 8/2000 Cueman et al.
6,110,346 A 8/2000 Reid et al.
6,124,203 A 9/2000 Joo et al.
6,126,798 A 10/2000 Reid et al.
6,139,712 A 10/2000 Patton et al.
6,156,167 A 12/2000 Patton et al.
6,159,354 A 12/2000 Contolini et al.
6,162,344 A 12/2000 Reid et al.
6,176,985 B1 1/2001 Downes, Jr. et al.
6,179,973 B1 1/2001 Lai et al.
6,179,983 B1 1/2001 Reid et al.
6,193,854 B1 2/2001 Lai et al.
6,217,716 B1 4/2001 Lai
6,221,757 B1 4/2001 Schmidbauer et al.
6,251,238 B1 6/2001 Kaufman et al.
6,251,242 B1 6/2001 Fu et al.
6,261,433 B1 7/2001 Landau
6,267,860 B1 7/2001 Brodsky
6,270,646 B1 8/2001 Walton et al.
6,274,008 B1 8/2001 Gopalraja et al.
6,277,249 B1 8/2001 Gopalraja et al.
6,303,010 B1 10/2001 Woodruff et al.
6,309,520 B1 10/2001 Woodruff et al.
6,309,981 B1 10/2001 Mayer et al.
6,379,468 B1 4/2002 Chang et al.
RE37,749 E 6/2002 Poris
6,398,926 B1 6/2002 Mahneke
6,413,388 B1 7/2002 Uzoh et al.
6,436,249 B1 8/2002 Patton et al.
6,517,689 B1 2/2003 Hongo et al.
6,540,899 B2 4/2003 Keigler
6,551,487 B1 4/2003 Reid et al.
6,579,430 B2 6/2003 Davis et al.
6,589,401 B1 7/2003 Patton et al.
6,612,915 B1 9/2003 Uzoh et al.
6,613,214 B2 9/2003 Dordi et al.
6,627,052 B2 9/2003 Fluegel et al.
6,755,946 B1 6/2004 Patton et al.
6,755,954 B2 6/2004 Mayer et al.
6,773,560 B2 8/2004 Pedersen et al.
6,800,187 B1 10/2004 Reid et al.
6,869,510 B2 3/2005 Woodruff et al.
6,908,540 B2 6/2005 Kholodenko
7,033,465 B1 4/2006 Patton et al.
7,070,686 B2 7/2006 Contolini et al.
7,087,144 B2 8/2006 Herchen
7,285,195 B2 10/2007 Herchen et al.
7,522,055 B2 4/2009 Carrender et al.
7,935,231 B2 5/2011 Ghongadi et al.
7,985,325 B2 * 7/2011 Rash ..... C25D 17/02 204/242
8,172,992 B2 5/2012 Prabhakar et al.
8,377,268 B2 2/2013 Rash et al.
8,398,831 B2 3/2013 Ghongadi et al.
9,221,081 B1 12/2015 Mayer et al.
9,228,270 B2 * 1/2016 Feng ..... C25D 17/06
9,476,139 B2 10/2016 Chua et al.
9,746,427 B2 8/2017 Mayer et al.
2001/0020480 A1 9/2001 Yoshikawa et al.
2002/0000372 A1 1/2002 Pedersen et al.
2002/0020763 A1 2/2002 Hirae et al.
2002/0084183 A1 7/2002 Hanson et al.
2002/0108851 A1 8/2002 Woodruff et al.
2002/0134403 A1 9/2002 Selwyn et al.
2002/0144900 A1 10/2002 Keigler
2002/0153260 A1 10/2002 Egli et al.
2002/0157686 A1 10/2002 Kenny et al.
2003/0010641 A1 1/2003 Kholodenko
2003/0085118 A1 5/2003 Tench et al.
2003/0085119 A1 5/2003 Davis et al.
2003/0134044 A1 7/2003 Aoki et al.
2003/0181349 A1 9/2003 Maeno et al.
2003/0201184 A1 10/2003 Dordi et al.
2004/0002430 A1 1/2004 Verhaverbeke
2004/0060576 A1 4/2004 Cronin et al.
2004/0084301 A1 5/2004 Dordi et al.
2004/0112405 A1 6/2004 Lee et al.
2004/0149573 A1 * 8/2004 Herchen ..... C25D 17/06 204/297.01
2004/0171277 A1 9/2004 Oh et al.
2005/0081899 A1 4/2005 Shannon
2005/0183947 A1 8/2005 Henuset
2005/0218000 A1 10/2005 Hafezi et al.
2005/0284754 A1 12/2005 Herchen et al.
2005/0287928 A1 12/2005 Hardikar et al.
2006/0118132 A1 6/2006 Bergman et al.
2006/0151007 A1 7/2006 Bergman
2006/0226000 A1 10/2006 Hanson et al.
2006/0237308 A1 10/2006 Herchen
2006/0246690 A1 11/2006 Dordi et al.
2006/0266653 A1 11/2006 Birang et al.
2007/0077871 A1 4/2007 Park et al.
2007/0141849 A1 6/2007 Kanno et al.
2007/0199578 A1 8/2007 Nomura et al.
2008/0011322 A1 1/2008 Weber et al.
2008/0117051 A1 5/2008 Carrender et al.
2009/0009753 A1 1/2009 Horai et al.
2009/0033889 A1 2/2009 Bleeker et al.
2009/0107835 A1 4/2009 Ghongadi et al.
2009/0107836 A1 * 4/2009 Rash ..... C25D 17/02 204/297.01
2009/0117730 A1 5/2009 Maitani et al.
2010/0116290 A1 5/2010 Zhu et al.
2010/0144158 A1 6/2010 Ito et al.
2010/0155254 A1 6/2010 Prabhakar et al.
2010/0216302 A1 8/2010 Luo et al.
2011/0181000 A1 7/2011 Ghongadi et al.
2011/0233056 A1 9/2011 Rash et al.
2012/0043200 A1 2/2012 Fujikata et al.
2012/0137970 A1 6/2012 Naruse et al.
2012/0181170 A1 7/2012 Prabhakar et al.
2013/0042454 A1 2/2013 Feng et al.
2013/0062197 A1 * 3/2013 He ..... C25D 17/001 204/297.05
2013/0256146 A1 10/2013 Chua et al.
2013/0292254 A1 11/2013 Kumar et al.
2014/0230855 A1 8/2014 Mayer et al.

(56) References Cited

U.S. PATENT DOCUMENTS

| | | | |
|---|---|---|---|
| 2014/0367265 | A1 | 12/2014 | Ravid et al. |
| 2016/0145761 | A1 | 5/2016 | Mayer et al. |
| 2016/0186355 | A1 | 6/2016 | Feng et al. |
| 2016/0201212 | A1 | 7/2016 | Ostrowski et al. |
| 2017/0009369 | A1 | 1/2017 | Berke et al. |
| 2017/0009370 | A1 | 1/2017 | Chua et al. |
| 2017/0073832 | A1 | 3/2017 | Berke et al. |
| 2017/0299524 | A1 | 10/2017 | Arora et al. |

FOREIGN PATENT DOCUMENTS

| | | | |
|---|---|---|---|
| CN | 1930666 | A | 3/2007 |
| CN | 100469948 | C | 3/2009 |
| CN | 101599420 | | 12/2009 |
| CN | 101798698 | | 8/2010 |
| CN | 102953104 | A | 3/2013 |
| CN | 103031580 | A | 4/2013 |
| EP | 1 724 820 | A1 | 11/2006 |
| JP | 2002-069698 | | 3/2002 |
| JP | 2002-540011 | | 11/2002 |
| JP | 2004-83932 | | 3/2004 |
| JP | 2004-247738 | | 9/2004 |
| JP | 2004-270014 | | 9/2004 |
| JP | 2008-95157 | | 4/2008 |
| JP | 2010-150659 | | 7/2010 |
| KR | 10-2004-0079843 | | 9/2004 |
| KR | 10-2004-0081577 | | 9/2004 |
| KR | 10-2005-0068038 | | 7/2005 |
| KR | 10-2008-0007931 | | 1/2008 |
| TW | 531770 | | 5/2003 |
| TW | 544811 | | 8/2003 |
| TW | 200409836 | | 6/2004 |
| TW | 200410296 | A | 6/2004 |
| TW | 200511422 | A | 3/2005 |
| TW | I244548 | | 12/2005 |
| TW | I1585246 | B | 6/2017 |
| WO | WO 99/41434 | | 8/1999 |
| WO | WO 03/006718 | | 1/2003 |
| WO | WO 2013/148890 | | 10/2013 |

OTHER PUBLICATIONS

U.S. Office Action, dated Nov. 1, 2011, issued in U.S. Appl. No. 12/633,219.
U.S. Notice of Allowance, dated Jan. 12, 2012, issued in U.S. Appl. No. 12/633,219.
U.S. Notice of Allowance, dated Mar. 19, 2012, issued in U.S. Appl. No. 12/633,219.
U.S. Office Action, dated Oct. 26, 2012, issued in U.S. Appl. No. 13/432,767.
U.S. Final Office Action, dated Nov. 26, 2013, issued in U.S. Appl. No. 13/432,767.
U.S. Office Action, dated Nov. 6, 2014, issued in U.S. Appl. No. 13/563,619.
U.S. Office Action, dated Feb. 23, 2015, issued in U.S. Appl. No. 13/584,343.
U.S. Office Action, dated Mar. 2, 2011, issued in U.S. Appl. No. 11/929,638.
U.S. Notice of Allowance, dated May 23, 2011, issued in U.S. Appl. No. 11/929,638.
U.S. Office Action, dated Jul. 7, 2010, issued in U.S. Appl. No. 11/932,595.
U.S. Final Office Action, dated Nov. 17, 2010, issued in U.S. Appl. No. 11/932,595.
U.S. Notice of Allowance, dated Jan. 26, 2011, issued in U.S. Appl. No. 11/932,595.
U.S. Notice of Allowance, dated Mar. 8, 2011, issued in U.S. Appl. No. 11/932,595.
U.S. Notice of Allowance (Supplemental Notice of Allowability) dated Mar. 11, 2011, issued in U.S. Appl. No. 11/932,595.
U.S. Notice of Allowance, dated Mar. 18, 2011, issued in U.S. Appl. No. 11/932,595.
U.S. Office Action, dated Nov. 4, 2011, issued in U.S. Appl. No. 13/154,224.
U.S. Office Action, dated Mar. 16, 2012, issued in U.S. Appl. No. 13/154,224.
U.S. Final Office Action, dated Jul. 18, 2012, issued in U.S. Appl. No. 13/154,224.
U.S. Notice of Allowance, dated Oct. 4, 2012, issued in U.S. Appl. No. 13/154,224.
U.S. Notice of Allowance (Corrected Notice of Allowability) dated Jan. 23, 2013, issued in U.S. Appl. No. 13/154,224.
U.S. Office Action, dated May 21, 2012, issued in U.S. Appl. No. 13/079,745.
U.S. Office Action, dated Sep. 21, 2012, issued in U.S. Appl. No. 13/079,745.
U.S. Notice of Allowance, dated Nov. 19, 2012, issued in U.S. Appl. No. 13/079,745.
Chinese First Office Action dated May 2, 2013 issued in CN 200910211989.X.
Japanese Office Action, dated Oct. 2, 2012, issued in Application No. 2009-278998.
Korean Description of Notification of Provisional Rejection, dated May 10, 2012, issued in Application No. 2009-0122738.
Korean Notification of Decision to Grant, dated Sep. 4, 2012, issued in Application No. 2009-0122738.
Singapore Search Report and Written Opinion, dated Mar. 9, 2011, issued in Application No. 200908245.4.
Singapore Search and Examination Report, dated Oct. 27, 2011, issued in Application No. 200908245.4.
Taiiwan International Search Report, dated Jun. 11, 2012, issued in Application No. 098142112.
Singapore Search Report and Written Opinion, dated Oct. 6, 2014, issued in Application No. 201206129-7.
PCT International Search Report and Written Opinion dated Jul. 25, 2013 issued in PCT/US2013/034178.
PCT International Preliminary Report on Patentability and Written Opinion dated Oct. 9, 2014 issued in PCT/US2013/034178.
Shin-Etsu Polymer Co., Ltd., "L-type connector," http://www.shinpoly.co.jp./business/connector/products_e/l/html?typezeb (one page) downloaded May 23, 2003.
Shin-Etsu Polymer Co., Ltd., "SS-type connector," http://www.shinpoly.co.jp./business/connector/products_e/ss.html?typezeb (2 pages) downloaded May 23, 2003.
U.S. Office Action, dated Nov. 23, 2016, issued in U.S. Appl. No. 14/178,804.
U.S. Notice of Allowance, dated May 3, 2017, issued in U.S. Appl. No. 14/178,804.
U.S. Final Office Action, dated Apr. 23, 2015, issued in U.S. Appl. No. 13/563,619.
U.S. Notice of Allowance, dated Aug. 31, 2015, issued in U.S. Appl. No. 13/563,619.
U.S. Notice of Allowance [corrected Notice of Allowability], dated Sep. 23, 2015, issued in U.S. Appl. No. 13/563,619.
U.S. Notice of Allowance, dated Aug. 31, 2015, issued in U.S. Appl. No. 13/584,343.
U.S. Notice of Allowance, dated Jun. 30, 2016, issued in U.S. Appl. No. 13/853,935.
U.S. Office Action, dated Oct. 28, 2015, issued in U.S. Appl. No. 13/852,767.
U.S. Final Office Action, dated Apr. 28, 2016, issued in U.S. Appl. No. 13/852,767.
U.S. Office Action, dated Feb. 24, 2017, issued in U.S. Appl. No. 13/852,767.
Chinese First Office Action dated Jan. 26, 2016, issued in Application No. CN 201210289735.1.
Chinese Second Office Action dated Nov. 2, 2016, issued in Application No. CN 201210289735.1.
Japanese First Office Action dated Jun. 28, 2016, issued in Application No. JP 2012-179853.
Japanese Second Office Action [no translation] dated Mar. 14, 2017, issued in Application No. JP 2012-179853.

(56) References Cited

OTHER PUBLICATIONS

Singapore Final Exam Report, dated May 20, 2015, issued in Application No. SG 201206129-7.
Taiwan Office Action and Search Report, dated May 12, 2016, issued in Application No. TW 101129602.
Chinese First Office Action dated Mar. 2, 2016 issued in Application No. CN 201380023757.6.
Chinese Second Office Action dated Jan. 24, 2017 issued in Application No. CN 201380023757.6.
Taiwan Examination and Search Report dated Oct. 12, 2016, issued in TW 102111233.
*Cambridge English Dictionary*, Meaning of "against" (2016), 2 pages.
Everett, D.H. (2001) "Definition of Surface Active Agents," *Manual of Symbols and Terminology for Physicochemical Quantities and Units*, Appendix II, *International Union of Pure and Applied Chemistry, Division of Physical Chemistry*, Adopted by the IUPAC Council at Washington DC, USA on Jul. 23, 1971, 6pp.
US Notice of Allowance [Corrected Notice of Allowability], dated Jul. 21, 2017, issued in U.S. Appl. No. 14/178,804.
US Office Action, dated Sep. 21, 2017, issued in U.S. Appl. No. 14/990,725.
US Notice of Allowance, dated Sep. 1, 2017, issued in U.S. Appl. No. 14/936,328.
US Office Action, dated Sep. 7, 2017, issued in U.S. Appl. No. 14/957,156.
US Final Office Action, dated Aug. 25, 2017, issued in U.S. Appl. No. 13/852,767.
Chinese First Office Action dated Jun. 20, 2017 issued in CN 201510837221.9.
Taiwan Office Action, dated Jul. 11, 2017, issued in Application No. TW 106105154.
Taiwan Notice of Allowance and Search Report, dated Sep. 8, 2017, issued in Application No. TW 102111465.
*Merriam-Webster Dictionary*, Definition of "Integrate" [Downloaded on Aug. 28, 2017 at https://www.merriam-webster.com/dictionary/integrate], 12pp.
*Wikipedia, the free encyclopedia*, Definition of "Through hole" [Downloaded on Aug. 24, 2017 from hups://en.wikipedia.org/wiki/Through_hole, 1 page.
U.S. Appl. No. 15/638,131, filing date Jun. 29, 2017, Arora et al.
US Office Action, dated Oct. 31, 2017, issued in U.S. Appl. No. 15/004,593.
DuPont Teflon, Dupont, May 2015, 5pp [Downloaded on Oct. 11, 2017 at https://web.arehive.org/web/20150301000000*https://plastics.ulprospeetor.com/generics/41/e/t/polyphenylene-sulfide-pps-properties-processing].
Guide to Whitford Industrial Coatings 2012, *Whitford Worldwide*, 3pp [Downloaded on Oct. 11, 2017 at https://web.archive.org/web/*/http://efpadm2.itum.com/files/files/rpn/7.pdf] (Year: 2012).
Zheng, CN 101599420a, abstract and machine translation (2009).

* cited by examiner

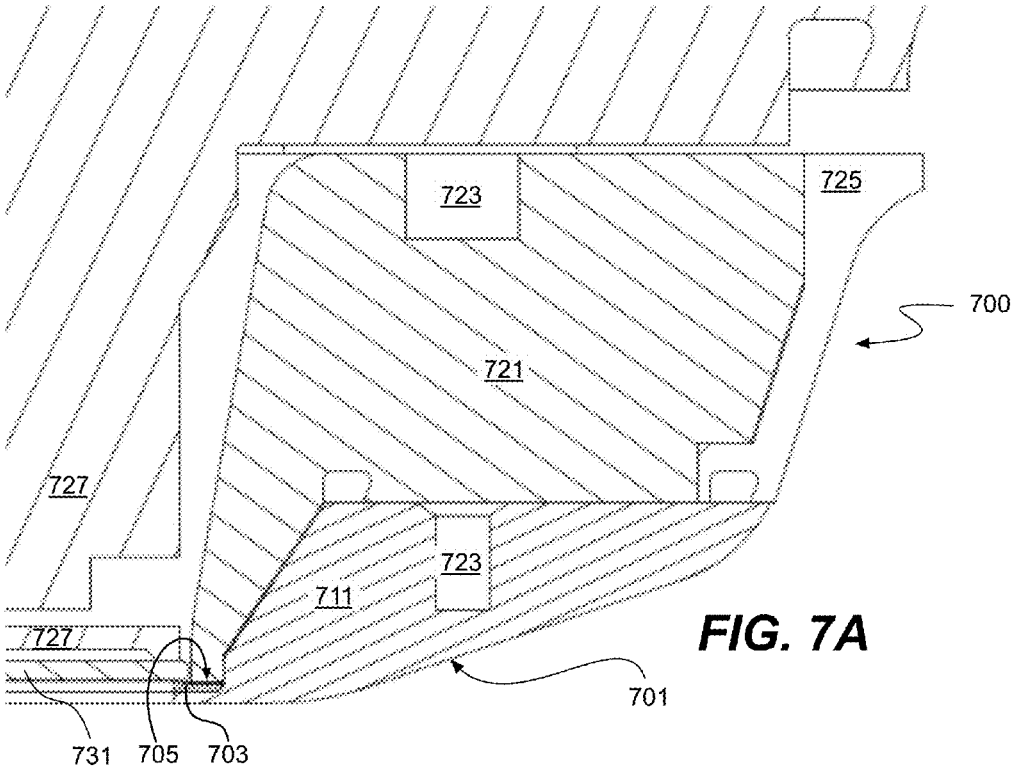
FIG. 7A
FIG. 7B
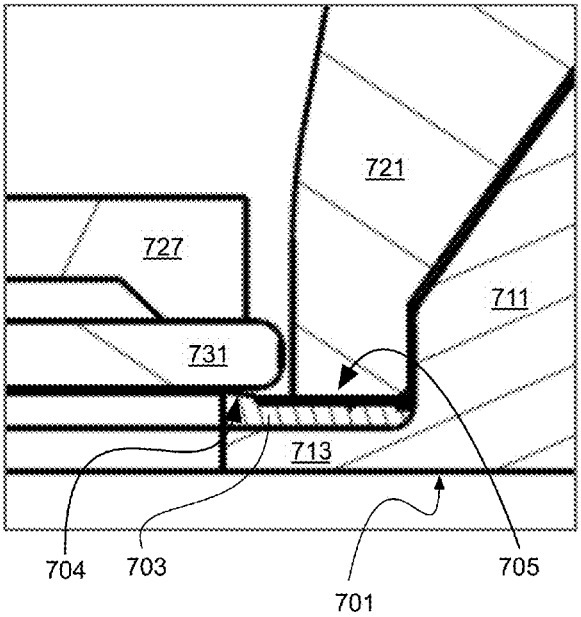
FIG. 7C
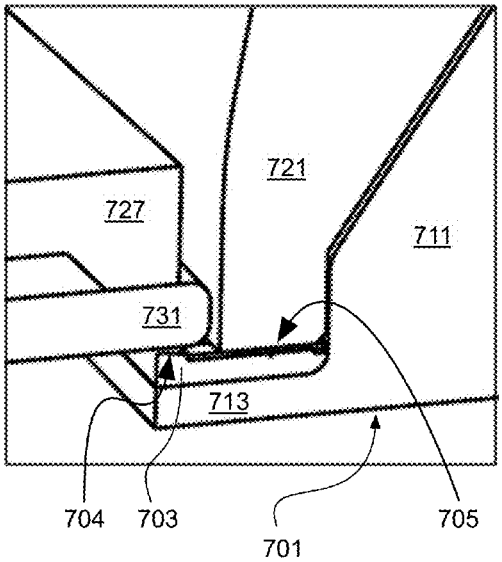

LIPSEALS AND CONTACT ELEMENTS FOR SEMICONDUCTOR ELECTROPLATING APPARATUSES

CROSS-REFERENCE TO RELATED APPLICATIONS

This application claims priority to and is a continuation-in-part of U.S. patent application Ser. No. 13/584,343, filed Aug. 13, 2012, and titled "LIPSEALS AND CONTACT ELEMENTS FOR SEMICONDUCTOR ELECTROPLATING APPARATUSES," which claims priority to U.S. Provisional Patent Application No. 61/523,800, filed Aug. 15, 2011, and titled "LIPSEALS AND CONTACT ELEMENTS FOR SEMICONDUCTOR ELECTROPLATING APPARATUSES."

This application also claims priority to U.S. Provisional Patent Application No. 62/085,171, filed Nov. 26, 2014, and titled "INTEGRATED LIPSEAL AND ELECTRICAL CONTACTS FOR WAFER PLATING."

Each of the foregoing patent applications are hereby incorporated by reference in their entirety and for all purposes.

TECHNICAL FIELD

This invention relates to the formation of damascene interconnects for integrated circuits, and electroplating apparatuses which are used during integrated circuit fabrication.

BACKGROUND

Electroplating is a common technique used in integrated circuit (IC) fabrication to deposit one or more layers of conductive metal. In some fabrication processes it is used to deposit single or multiple levels of copper interconnects between various substrate features. An apparatus for electroplating typically includes an electroplating cell having a pool/bath of electrolyte and a clamshell designed to hold a semiconductor substrate during electroplating.

During operation of the electroplating apparatus, a semiconductor substrate is submerged into the electrolyte pool such that one surface of the substrate is exposed to electrolyte. One or more electrical contacts established with the substrate surface are employed to drive an electrical current through the electroplating cell and deposit metal onto the substrate surface from metal ions available in the electrolyte. Typically, the electrical contact elements are used to form an electrical connection between the substrate and a bus bar acting as a current source. However, in some configurations, a conductive seed layer on the substrate contacted by the electrical connections may become thinner towards the edge of the substrate, making it more difficult to establish an optimal electrical connection with the substrate.

Another issue arising in electroplating is the potentially corrosive properties of the electroplating solution. Therefore, in many electroplating apparatus a lipseal is used at the interface of the clamshell and substrate for the purpose of preventing leakage of electrolyte and its contact with elements of the electroplating apparatus other than the inside of the electroplating cell and the side of the substrate designated for electroplating.

SUMMARY OF THE INVENTION

Disclosed herein are lipseal assemblies for use in an electroplating clamshell for engaging and supplying electrical current to a semiconductor substrate during electroplating. In some embodiments, a lipseal assembly may include an elastomeric lipseal for engaging the semiconductor substrate and one or more contact elements for supplying electrical current to the semiconductor substrate during electroplating. In some embodiments, upon engagement, the elastomeric lipseal substantially excludes plating solution from a peripheral region of the semiconductor substrate.

In some embodiments, the one or more contact elements are structurally integrated with the elastomeric lipseal and include a first exposed portion which contacts the peripheral region of the substrate upon engagement of the lipseal with the substrate. In some embodiments, the one or more contact elements may further include a second exposed portion for making an electrical connection with an electrical current source. In certain such embodiments, the current source may be a bus bar of the electroplating clamshell. In some embodiments, the one or more contact elements may further include a third exposed portion connecting the first and second exposed portions. In certain such embodiments, the third exposed portion may be structurally integrated on a surface of the elastomeric lipseal.

In some embodiments, the one or more contact elements may include an unexposed portion connecting the first and second exposed portions, and the unexposed portion may be structurally integrated underneath a surface of the elastomeric lipseal. In certain such embodiments, the elastomeric lipseal is molded over the unexposed portion.

In some embodiments, the elastomeric lipseal may include a first inner diameter defining a substantially circular perimeter for excluding a plating solution from a peripheral region, and the first exposed portion of the one or more contact elements may define a second inner diameter that is larger than the first inner diameter. In certain such embodiments, the magnitude of the difference between the first inner diameter and the second inner diameter is about or less than 0.5 mm. In certain such embodiments, the magnitude of the difference between the first inner diameter and the second inner diameter is about or less than 0.3 mm.

In some embodiments, a lipseal assembly may include one or more flexible contact elements for supplying electrical current to the semiconductor substrate during electroplating. In certain such embodiments, at least a portion of the one or more flexible contact elements may be conformally positioned on an upper surface of the elastomeric lipseal and, upon engagement with the semiconductor substrate, the flexible contact elements may be configured to flex and form a conformal contact surface that interfaces with the semiconductor substrate. In certain such embodiments, the conformal contact surface interfaces with a bevel edge of the semiconductor substrate.

In some embodiments, the one or more flexible contact elements may have a portion which is not configured to contact the substrate when the substrate is engaged by the lipseal assembly. In certain such embodiments, the non-contacting portion comprises a non-conformable material. In some embodiments, the conformal contact surface forms a continuous interface with the semiconductor substrate, whereas in some embodiments, the conformal contact surface forms a non-continuous interface with the semiconductor substrate having gaps. In certain such later embodiments, the one or more flexible contact elements may include multiple wire tips or a wire mesh disposed on the surface of the elastomeric lipseal. In some embodiments, the one or more flexible contact elements conformally positioned on the upper surface of the elastomeric lipseal include conductive deposits formed using one or more techniques selected from chemical vapor deposition, physical vapor deposition, and electroplating. In some embodiments, the one or more flexible contact elements conformally positioned on the upper surface of the elastomeric lipseal may include an electrically conductive elastomeric material.

Also disclosed herein are elastomeric lipseals for use in an electroplating clamshell for supporting, aligning, and sealing a semiconductor substrate in the electroplating clamshell. In some embodiments, the lipseal includes a flexible elastomeric support edge and a flexible elastomeric upper portion located above the flexible elastomeric support edge. In some embodiments, the flexible elastomeric support edge has a sealing protrusion configured to support and seal the semiconductor substrate. In certain such embodiments, upon sealing the substrate, the sealing protrusion defines a perimeter for excluding plating solution. In some embodiments, the flexible elastomeric upper portion includes a top surface configured to be compressed, and an inner side surface located outward relative to the sealing protrusion. In certain such embodiments, the inner side surface may be configured to move inward and align the semiconductor substrate upon compression of the top surface, and in some embodiments, configured to move inward by about or at least 0.2 mm upon compression of the top surface. In some embodiments, when the top surface is not compressed, the inner side surface is located sufficiently outward to allow the semiconductor substrate to be lowered through the flexible elastomeric upper portion and placed onto the sealing protrusion without contacting the upper portion, but wherein upon placement of the semiconductor substrate on the sealing protrusion and compression of the top surface, the inner side surface contacts and pushes on the semiconductor substrate aligning the semiconductor substrate in the electroplating clamshell.

Also disclosed herein are methods of aligning and sealing a semiconductor substrate in an electroplating clamshell having an elastomeric lipseal. In some embodiments, the methods include opening the clamshell, providing a substrate to the clamshell, lowering the substrate through an upper portion of the lipseal and onto a sealing protrusion of the lipseal, compressing a top surface of the upper portion of the lipseal to align the substrate, and pressing on the substrate to form a seal between the sealing protrusion and the substrate. In some embodiments, compressing the top surface of the upper portion of the lipseal causes an inner side surface of the upper portion of the lipseal to push on the substrate aligning it in the clamshell. In some embodiments, compressing the top surface to align the substrate includes pressing on the top surface with a first surface of the cone of the clamshell, and pressing on the substrate to form a seal includes pressing on the substrate with a second surface of the cone of the clamshell.

In some embodiments, compressing the top surface to align the substrate includes pushing on the top surface with a first pressing component of the clamshell, and pressing on the substrate to form a seal includes pressing on the substrate with a second pressing component of the clamshell. In certain such embodiments, the second pressing component may be independently movable with respect to the first pressing component. In certain such embodiments, compressing the top surface includes adjusting the pressing force exerted by the first pressing component based upon the diameter of the semiconductor substrate.

Also disclosed herein are cup assemblies for holding, sealing, and providing electrical power to a semiconductor substrate during electroplating which include a cup bottom element including a main body portion and a moment arm, an elastomeric sealing element disposed on the moment arm, and an electrical contact element disposed on the elastomeric sealing element. The elastomeric sealing element, when pressed against by the semiconductor substrate, may seal against the substrate so as to define a peripheral region of the substrate from which plating solution is substantially excluded during electroplating, and the electrical contact element may contact the substrate in said peripheral region when the sealing element seals against the substrate so that the contact element may provide electrical power to the substrate during electroplating. In some embodiments, the main body portion does not substantially flex when the semiconductor substrate is pressed against the moment arm, In some embodiments, the main body portion is rigidly affixed to another feature of the cup structure and the ratio of the average vertical thickness of the main body portion to the average vertical thickness of the moment arm is greater than about 5 so that the main body portion does not substantially flex when the semiconductor substrate is pressed against the moment arm. In some embodiments, the electrical contact element has a substantially flat but flexible contact portion disposed upon a substantially horizontal portion of the elastomeric sealing element. In some embodiments, the elastomeric sealing element is integrated with the cup bottom element during manufacturing.

BRIEF DESCRIPTION OF THE DRAWINGS

FIG. 7A is a cross-sectional schematic of a cup assembly having a cup bottom element, an elastomeric ring, and a contact ring.

FIG. 7B presents a magnified view of the cross-sectional schematic shown in FIG. 7A.

FIG. 7C presents a perspective view of the cross-section depicted in FIG. 7A.

DETAILED DESCRIPTION

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with specific embodiments, it will be understood that these embodiments are not intended to be limiting.

Figure 1:
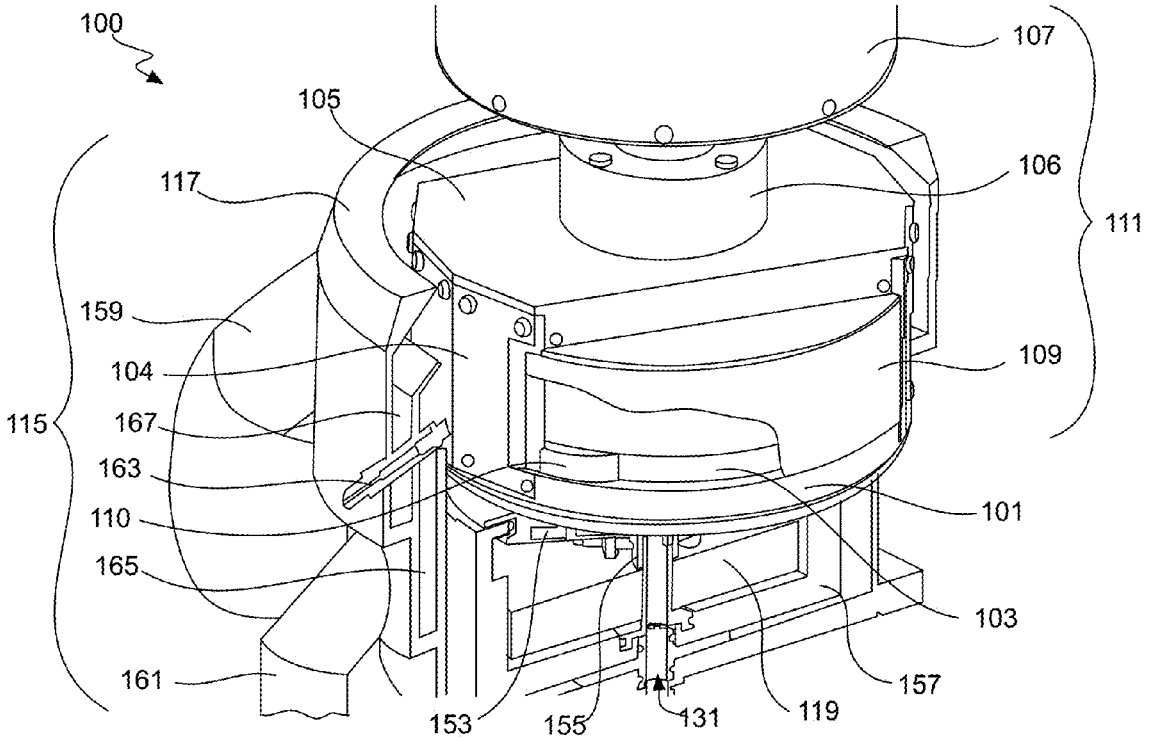
FIG. 1 is a perspective view of a wafer holding and positioning apparatus for electrochemically treating semiconductor wafers.

An exemplary electroplating apparatus is presented in FIG. 1 in order to provide some context for the various lipseal and contact element embodiments disclosed herein. Specifically, FIG. 1 presents a perspective view of a wafer holding and positioning apparatus 100 for electrochemically treating semiconductor wafers. The apparatus 100 includes wafer-engaging components, which are sometimes referred to as "clamshell components," or a "clamshell assembly," or just as a "clamshell." The clamshell assembly comprises a cup 101 and a cone 103. As will be shown in subsequent figures, the cup 101 holds a wafer and the cone 103 clamps the wafer securely in the cup. Other cup and cone designs beyond those specifically depicted here can be used. A common feature is that a cup that has an interior region in which the wafer resides and a cone that presses the wafer against the cup to hold it in place.

In the depicted embodiment, the clamshell assembly (which includes the cup 101 and the cone 103) is supported by struts 104, which are connected to a top plate 105. This assembly (101, 103, 104, and 105) is driven by a motor 107 via a spindle 106 connected to the top plate 105. The motor 107 is attached to a mounting bracket (not shown). The spindle 106 transmits torque (from the motor 107) to the clamshell assembly causing rotation of a wafer (not shown in this figure) held therein during plating. An air cylinder (not shown) within the spindle 106 also provides a vertical force for engaging the cup 101 with the cone 103. When the clamshell is disengaged (not shown), a robot with an end effector arm can insert a wafer in between the cup 101 and the cone 103. After a wafer is inserted, the cone 103 is engaged with the cup 101, which immobilizes the wafer within apparatus 100 leaving a working surface on one side of the wafer (but not the other) exposed for contact with the electrolyte solution.

In certain embodiments, the clamshell assembly includes a spray skirt 109 that protects the cone 103 from splashing electrolyte. In the depicted embodiment, the spray skirt 109 includes a vertical circumferential sleeve and a circular cap portion. A spacing member 110 maintains separation between the spray skirt 109 and the cone 103.

For the purposes of this discussion, the assembly including components 101-110 is collectively referred to as a "wafer holder" (or "substrate holder") 111. Note however, that the concept of a "wafer holder"/"substrate holder" extends generally to various combinations and sub-combinations of components that engage a wafer/substrate and allow its movement and positioning.

A tilting assembly (not shown) may be connected to the wafer holder to permit angled immersion (as opposed to flat horizontal immersion) of the wafer into a plating solution. A drive mechanism and arrangement of plates and pivot joints are used in some embodiments to move wafer the holder 111 along an arced path (not shown) and, as a result, tilt the proximal end of wafer holder 111 (i.e., the cup and cone assembly).

Further, the entire wafer holder 111 is lifted vertically either up or down to immerse the proximal end of wafer holder into a plating solution via an actuator (not shown). Thus, a two-component positioning mechanism provides both vertical movement along a trajectory perpendicular to an electrolyte surface and a tilting movement allowing deviation from a horizontal orientation (i.e., parallel to the electrolyte surface) for the wafer (angled-wafer immersion capability).

Note that the wafer holder 111 is used with a plating cell 115 having a plating chamber 117 which houses an anode chamber 157 and a plating solution. The chamber 157 holds an anode 119 (e.g., a copper anode) and may include membranes or other separators designed to maintain different electrolyte chemistries in the anode compartment and a cathode compartment. In the depicted embodiment, a diffuser 153 is employed for directing electrolyte upward toward the rotating wafer in a uniform front. In certain embodiments, the flow diffuser is a high resistance virtual anode (HRVA) plate, which is made of a solid piece of insulating material (e.g. plastic), having a large number (e.g. 4,000-15,000) of one dimensional small holes (0.01 to 0.050 inches in diameter) and connected to the cathode chamber above the plate. The total cross-section area of the holes is less than about 5 percent of the total projected area, and, therefore, introduces substantial flow resistance in the plating cell helping to improve the plating uniformity of the system. Additional description of a high resistance virtual anode plate and a corresponding apparatus for electrochemically treating semiconductor wafers is provided in U.S. patent application Ser. No. 12/291,356, filed on Nov. 7, 2008, which is hereby incorporated by reference herein in its entirety for all purposes. The plating cell may also include a separate membrane for controlling and creating separate electrolyte flow patterns. In another embodiment, a membrane is employed to define an anode chamber, which contains electrolyte that is substantially free of suppressors, accelerators, or other organic plating additives.

The plating cell 115 may also include plumbing or plumbing contacts for circulating electrolyte through the plating cell—and against the work piece being plated. For example, the plating cell 115 includes an electrolyte inlet tube 131 that extends vertically into the center of anode chamber 157 through a hole in the center of anode 119. In other embodiments, the cell includes an electrolyte inlet manifold that introduces fluid into the cathode chamber below the diffuser/HRVA plate at the peripheral wall of the chamber (not shown). In some cases, the inlet tube 131 includes outlet nozzles on both sides (the anode side and the cathode side) of the membrane 153. This arrangement delivers electrolyte to both the anode chamber and the cathode chamber. In other embodiments, the anode and cathode chamber are separated by a flow resistant membrane 153, and each chamber has a separate flow cycle of separated electrolyte. As shown in the embodiment of FIG. 1, an inlet nozzle 155 provides electrolyte to the anode-side of membrane 153.

In addition, plating cell 115 includes a rinse drain line 159 and a plating solution return line 161, each connected directly to the plating chamber 117. Also, a rinse nozzle 163 delivers deionized rinse water to clean the wafer and/or cup during normal operation. Plating solution normally fills much of the chamber 117. To mitigate splashing and generation of bubbles, the chamber 117 includes an inner weir 165 for plating solution return and an outer weir 167 for rinse water return. In the depicted embodiment, these weirs are circumferential vertical slots in the wall of the plating chamber 117.

As stated above, an electroplating clamshell typically includes a lipseal and one or more contact elements to provide sealing and electrical connection functions. A lipseal may be made from an elastomeric material. The lipseal forms a seal with the surface of the semiconductor substrate and excludes the electrolyte from a peripheral region of the substrate. No deposition occurs in this peripheral region and it is not used for forming IC devices, i.e., the peripheral region is not a part of the working surface. Sometimes, this region is also referred to as an edge exclusion area because the electrolyte is excluded from the area. The peripheral region is used for supporting and sealing the substrate during processing, as well as for making electrical connection with the contact elements. Since it is generally desirable to increase the working surface, the peripheral region needs to be as small as possible while maintaining the functions described above. In certain embodiments, the peripheral region is between about 0.5 millimeters and 3 millimeters from the edge of the substrate.

During installation, the lipseal and contact elements are assembled together with other components of the clamshell. One having ordinary skilled in the art would appreciated the difficulty of this operation, particularly, when the peripheral region is small. An overall opening provided by this clamshell is comparable to the size of the substrate (e.g., an opening for accommodating 200 mm wafers, 300 mm wafers, 450 mm wafers, etc.). Furthermore, substrates have their own size tolerances (e.g., +/−0.2 millimeters for a typical 300 mm wafer according to the SEMI specification). A particularly difficult task is alignment of the elastomeric lipseal and contact elements, since both are made from relatively flexible materials. These two components need to have very precise relative location. When a sealing edge of the lipseal and contact elements are positioned too far away from each other, insufficient or no electrical connection may be formed between the contacts and substrate during operation of the clamshell. At the same time, when the sealing edge is positioned too close to the contacts, the contacts may interfere with the seal and cause leakage into the peripheral region. For example, conventional contact rings are often made with multiple flexible "fingers" that are pressed in a spring-like action onto the substrate to establish an electrical connection as shown in the clamshell assembly of FIG. 2 (note cup 201, cone 203, and lipseal 212). Not only are these flexible fingers 208 very difficult to align with respect to the lipseal 212, they are also easily damaged during installation and difficult to clean if and when electrolyte gets into the periphery region.

Lipseal Assemblies Having Integrated Contact Elements

Provided herein are novel lipseal assemblies having contact elements integrated into elastomeric lipseals. Instead of installing and aligning two separate sealing and electrical components (e.g., a lipseal and a contact ring) in the field, the two components are aligned and integrated during fabrication of the assembly. This alignment is maintained during installation as well as during operation of the clamshell. As such, the alignment needs to be set and inspected only once, i.e., during fabrication of the assembly.

Figure 3A:
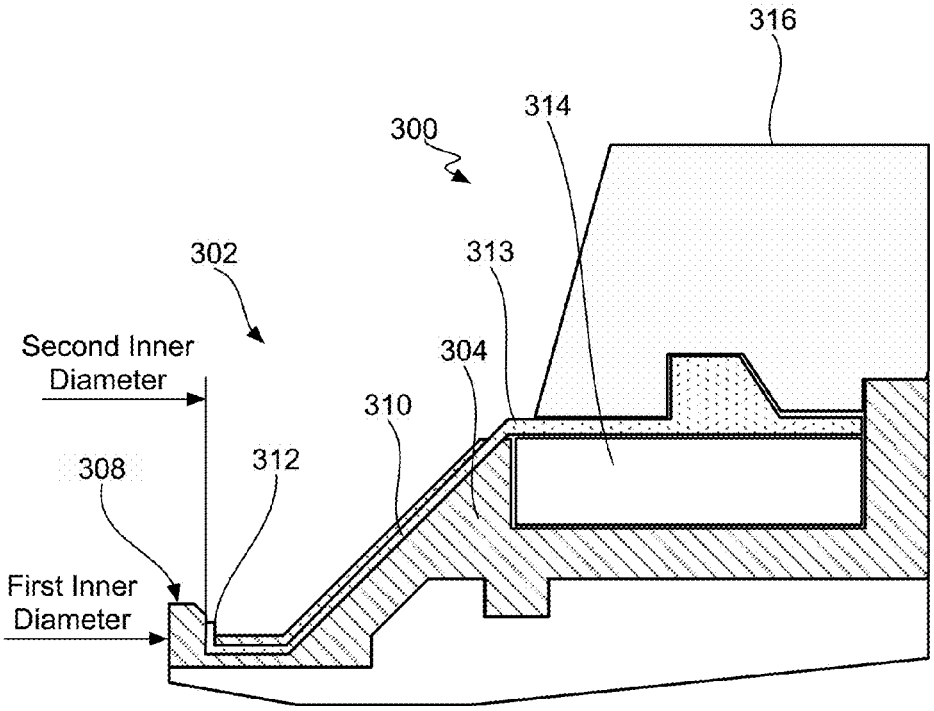
FIG. 3A is a cross-sectional schematic of a clamshell assembly having a lipseal assembly with integrated contact elements.

FIG. 3A is a schematic representation of a portion of a clamshell 300 having a lipseal assembly 302, in accordance with certain embodiments. Lipseal assembly 302 includes an elastomeric lipseal 304 for engaging the semiconductor substrate (not shown). Lipseal 304 forms a seal with the substrate and excludes a plating solution from a peripheral region of the semiconductor substrate as described in other parts of this document. Lipseal 304 may include protrusion 308 extending upwards and towards the substrate. The protrusion may be compressed and to certain degree deformed to establish the seal. Lipseal 304 has an inner diameter defining a perimeter for excluding the plating solution from the peripheral region.

Lipseal assembly 302 also includes one or more contact elements 310 structurally integrated into lipseal 304. As stated above, contact element 310 is used for supplying an electrical current to the semiconductor substrate during electroplating. Contact element 310 includes an exposed portion 312 defining a second inner diameter that is larger than the first inner diameter of lipseal 304 in order to prevent interference with the sealing properties of lipseal assembly 302. Contact element 310 generally includes another exposed portion 313 for making an electrical connection with a source of electrical current such as a bus bar 316 of the electroplating clamshell. However, other connection schemes are also possible. For example, contact element 310 may be interconnected with distribution bus 314, which may be connected to bus bar 316.

As stated above, integration of one or more contact elements 310 into lipseal 304 is performed during fabrication of lipseal assembly 302 and is preserved during installation and operation of the assembly. This integration may be performed in a variety of ways. For example, an elastomeric material may be molded over contact element 310. Other elements, such as current distribution bus 314, may be also integrated into the assembly to improve rigidity, conductivity, and other functionalities of assembly 302.

The lipseal assembly 302 illustrated in FIG. 3A has a contact element 310 with a middle unexposed portion located between the two exposed portions 312 and 313 and connecting the two exposed portions. This unexposed portion extends through the body of the elastomeric lipseal 304 and is fully enclosed by the elastomeric lipseal 304 being structurally integrated underneath a surface of the elastomeric lipseal. This type of lipseal assembly 302 may be formed, for example, by molding the elastomeric lipseal 304 over the unexposed portion of contact element 310. Such a contact element may be particularly easy to clean since only small portions of contact element 310 extend to the surface of lipseal assembly 302 and are exposed.

Figure 3B:
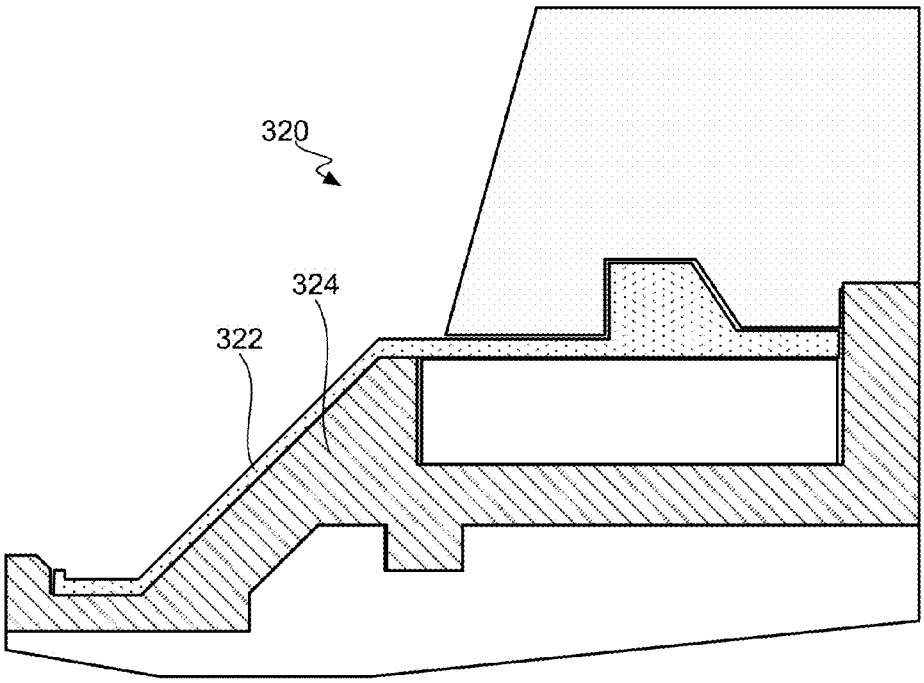
FIG. 3B is a cross-sectional schematic of another clamshell assembly having a different lipseal assembly with integrated contact elements.

FIG. 3B illustrates another embodiment where contact element 322 extends on the surface of elastomeric lipseal 304 and does not have a middle region enclosed by the lipseal assembly. In some embodiments, the middle region could be viewed as a third exposed portion of the contact element which is structurally integrated on a surface of the elastomeric lipseal, and is located between the first two exposed portions of the contact element 312 and 313, connecting these two portions. This embodiment may be assembled, for example, by pressing contact element 322 into the surface, or by molding it into the surface, or by gluing it to the surface, or by otherwise attaching it to the surface. Regardless of how the contact elements are integrated into the elastomeric lipseal, a point or surface of the contact element making an electrical connection to the substrate will preferentially maintain its alignment with respect to the point or surface of the lipseal making a seal with the substrate. Other portions of the contact element and lipseal may be movable with respect to each other. For example, an exposed portion of the contact element that makes an electrical connection to the bus bar may move with respect to the lipseal.

Returning to FIG. 3A, the first inner diameter defines the peripheral region while the second inner diameter defines overlap between the contact element and substrate. In certain embodiments, the magnitude of the difference between the first and second inner diameters is about or less than 0.5 millimeters (mm), which means that exposed portion 312 of contact element 310 is separated by about or less than 0.25 mm from the electrolyte solution. This small separation allows having a relatively small peripheral region while maintaining a sufficient electrical connection to the substrate. In certain such embodiments, the magnitude of the difference between the first and second inner diameters is about or less than 0.4 mm, or about or less than 0.3 mm, or about or less than 0.2 mm, or about or less than 0.1 mm. In other embodiments, the magnitude of the difference between these diameters may be about or less than 0.6 mm, or about or less than 0.7 mm, or about or less than 1 mm. In certain embodiments, the contact elements are configured to conduct at least about 30 Amperes or, more specifically, at least about 60 Amperes. A contact element may include multiple fingers such that each contacting tip of these fingers is fixed with respect to the edge of the lipseal. In the same or other embodiments, an exposed portion of the one or more contact elements includes multiple contact points. These contacts points may extend away from the surface of the elastomeric lipseal. In other embodiments, an exposed portion of the one or more contact elements includes a continuous surface.

Lipseal Assemblies Having Flexible Contact Elements which Forma Conformal Contact Surface Electrical connection to the substrate may be significantly improved by increasing the contact surface between the contact elements and the substrate during the sealing of the substrate in the clamshell assembly and the subsequent electroplating. Conventional contact elements (e.g., "fingers" shown in FIG. 2) are designed to make only a "point contact" with the substrate that has a relatively small contact area. When a tip of the contact finger touches the substrate, the finger bends to provide a force against the substrate. While this force may help to decrease the contact resistance somewhat, there oftentimes still remains enough contact resistance to create problems during electroplating. Furthermore, the contact fingers may become damaged over time by many repetitions of the bending action.

Described herein are lipseal assemblies having one or more flexible contact elements conformally positioned on an upper surface of an elastomeric lipseal. These contact elements are configured to flex upon engagement with semiconductor substrate and form a conformal contact surface that interfaces with the semiconductor substrate when the substrate is supported, engaged, and sealed by the lipseal assembly. The conformal contact surface is created when the substrate is pressed against the lipseal in a manner similar to the manner in which the seal is created between the substrate and the lipseal. Thus, pressing of the substrate against the contact element may cause the elastomeric material upon which the contact element is disposed to compress and exert a spring-like counter-force which may facilitate the conforming of the contact element to the shape of the substrate. However, despite the elastomeric material upon which the contact element is disposed being contiguous in some embodiments with the elastomeric material which forms the sealing interface, the sealing interface should generally be distinguished from the conformal contact surface formed between the contact element and the substrate even though the two surfaces may be formed adjacent to one another. It is also to be noted that when it is said herein that the conformal contact element "conforms" to the shape of the substrate, or more specifically "conforms" to the shape of the edge bevel region of the substrate, or that the forming of an electrical connection includes "conforming" of the contact element to the shape of the substrate, it should be understood that although this entails the shape of the contact element adjusting to match some portion of the shape of the substrate, it does not imply that the entirety of the contact element's shape adjusts to the shape of the substrate, or that the entire substrate's radial edge profile is matched by the shape of the contact element; instead, only that at least some portion of the contact element's shape is altered to approximately match some portion of the substrate's shape.

Figure 4A:
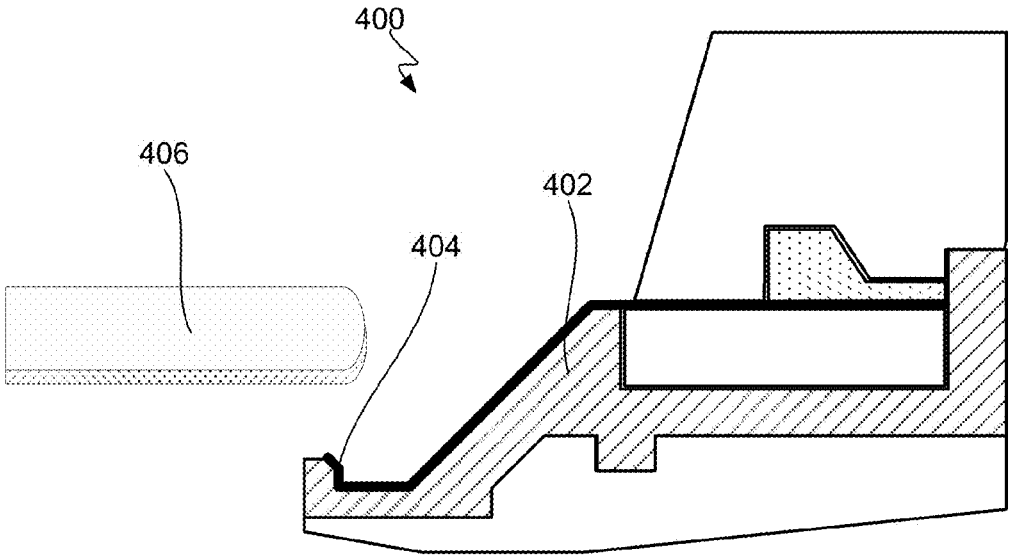
FIG. 4A is a cross-sectional schematic of a lipseal assembly having flexible contact elements.
Figure 4B:
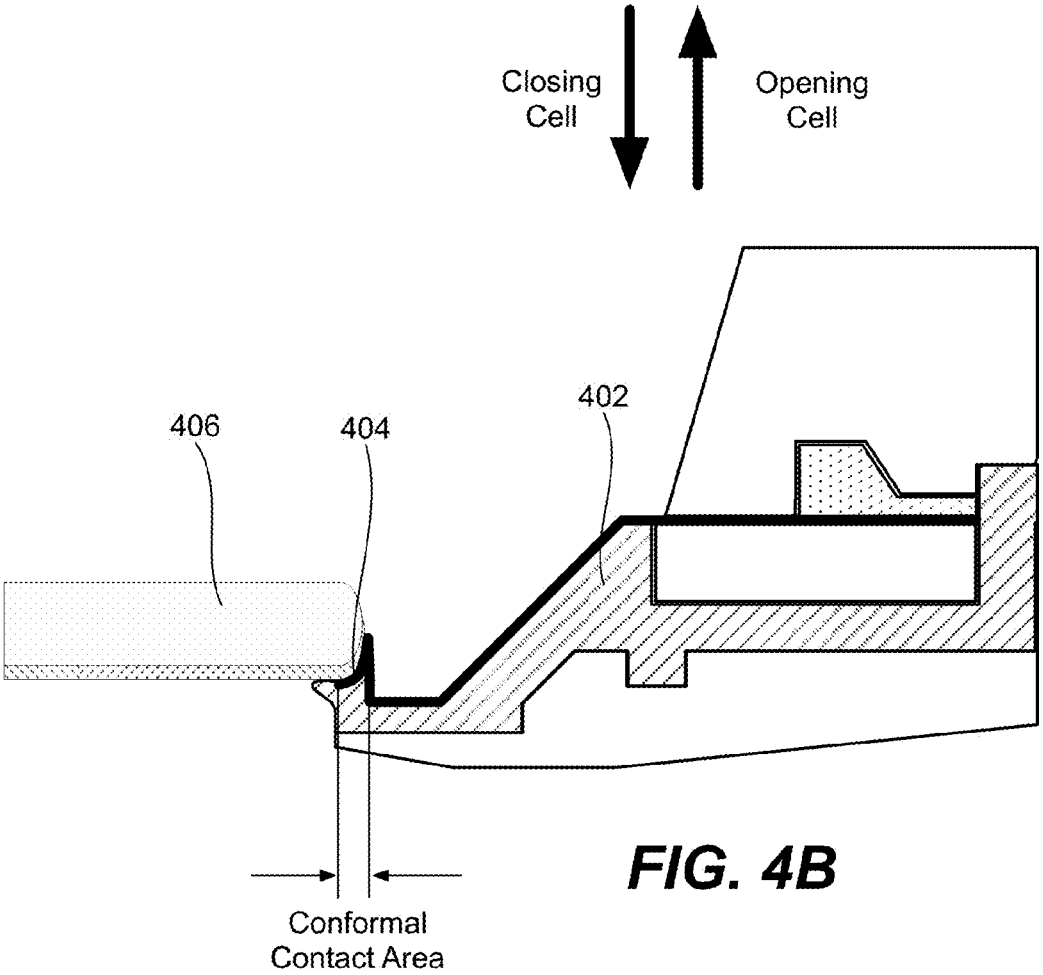
FIG. 4B is a cross-sectional schematic of the lipseal assembly of FIG. 4A shown forming a conformal contact surface interfacing with a semiconductor substrate.

FIG. 4A illustrates a lipseal assembly 400 having a flexible contact element 404 positioned on the upper surface of elastomeric lipseal 402 prior to positioning and sealing the substrate 406 onto lipseal 402, in accordance with certain embodiments. FIG. 4B illustrates the same lipseal assembly 400 after the substrate 406 has been positioned and sealed with the lipseal 402, in accordance with certain embodiments. Specifically, flexible contact element 404 is shown to flex and form a conformal contact surface at the interface with the substrate 406 when the substrate is held/engaged by the lipseal assembly. The electrical interface between flexible contact element 404 and substrate 406 may extend over the (flat) front surface of the substrate and/or the beveled edge surface of the substrate. Overall, a larger contact interface area is formed by providing a conformal contact surface of flexible contact element 404 at the interface with the substrate 406.

While the conformal nature of the flexible contact element 404 is important at the interface with the substrate, the remaining portion of flexible contact element 404 may also be conformal with respect to lipseal 402. For example, flexible contact element 404 may conformally extend along the surface of lipseal. In other embodiments, the remaining portion of the flexible contact element 404 may be made from other (e.g., non-conformal) materials and/or have a different (e.g., non-conformal) configuration. Therefore, in some embodiments, the one or more flexible contact elements may have a portion which is not configured to contact the substrate when the substrate is engaged by the lipseal assembly, and this non-contacting portion may comprise a conformable material, or it may comprise a non-conformable material.

Furthermore, it should be noted that although a conformal contact surface may form a continuous interface between the flexible contact element 404 and semiconductor substrate 406, it is not required to form a continuous interface. For example, in some embodiments, a conformal contact surface has gaps forming a non-continuous interface with the semiconductor substrate. Specifically, a non-continuous conformal contact surface may be formed from a flexible contact element 404 which comprises many multiple wire tips and/or a wire mesh disposed on the surface of the elastomeric lipseal. Even if non-continuous, the conformal contact surface follows the shape of the lipseal while the lipseal is being deformed during the closing of the clamshell.

Flexible contact element 404 may be attached to the upper surface of the elastomeric lipseal. For example, flexible contact element 404 may be pressed, glued, molded, or otherwise attached to the surface, as described above with reference to FIG. 3A and FIG. 3B (albeit not in the specific context of flexible contact elements which form a conformal contact surface). In other embodiments, flexible contact element 404 may be positioned over the upper surface of the elastomeric lipseal without providing any specific bonding features between the two. In either case, the force exerted by the semiconductor substrate on the flexible contact element 404 (when the clamshell is closed) causes compression of the elastomer under the contact element which then provides a spring-like counterforce which facilitates the conformality of the flexible contact element to the shape of the substrate.

Furthermore, although the portion of the flexible contact element 404 which interfaces with the substrate 406 (forming a conformal contact surface) is an exposed surface, other portions of the flexible contact element 404 may be unexposed, for example, being integrated underneath a surface of the elastomeric lipseal, in a manner somewhat similar to the integrated, albeit non-conformal, lipseal assembly illustrated in FIG. 3B.

In certain embodiments, a flexible contact element 404 includes a conductive layer of conductive deposits deposited on the upper surface of the elastomeric lipseal. The conductive layer of conductive deposits may be formed/deposited using chemical vapor deposition (CVD), and/or physical vapor deposition (PVD), and/or (electro)plating. In some embodiments, the flexible contact element 404 may be made of an electrically conductive elastomeric material.

Substrate Aligning Lipseals

As previously explained, the peripheral region of the substrate from which plating solution is excluded needs to be small, which requires careful and precise alignment of the semiconductor substrate prior to closing and sealing the clamshell. Misalignment may cause leaking on the one hand, and/or unnecessary covering/blocking of substrate working areas on the other. Tight substrate diameter tolerances may cause additional difficulties during alignment. Some alignment may be provide by the transfer mechanism (e.g., depending on the accuracy of a robot handoff mechanism), and by using alignment features such as snubbers positioned in the side walls of the clamshell cup. However, the transfer mechanism needs to be precisely installed and aligned during installation with respect to the cup (i.e., "taught" about relative position of other components) in order to provide precise and repetitive positioning of the substrates. This robot teaching and alignment process is rather difficult to perform, is labor intensive, and requires highly skilled personnel. Furthermore, the snubber features are difficult to install and tend to have big tolerance stack-ups because there are many parts positioned between the lipseal and snubbers.

Figure 5A:
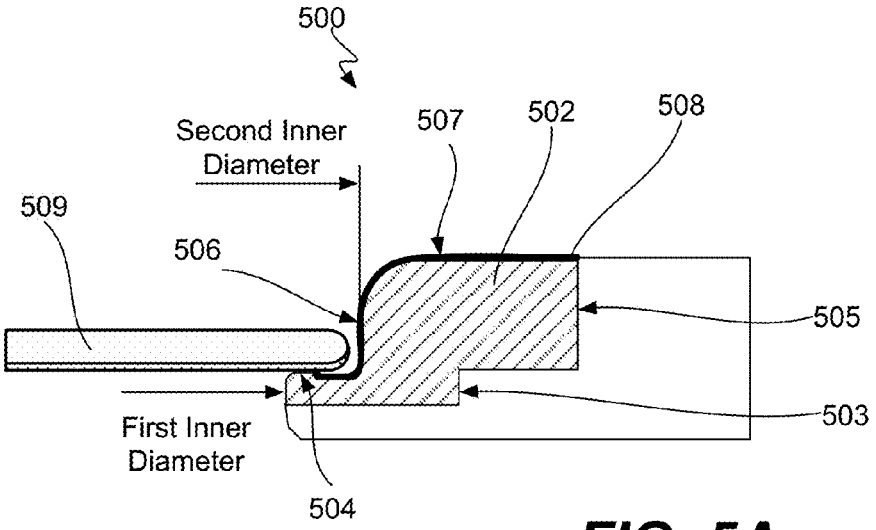
FIG. 5A is a cross-sectional schematic of a lipseal assembly configured to align a semiconductor substrate within a clamshell assembly.

Accordingly, disclosed herein are lipseals which are not only used for supporting and sealing the substrate in the clamshell but also for aligning the substrate in the clamshell prior to sealing. Various features of such lipseals will now be described with reference to FIGS. 5A through 5C. Specifically, FIG. 5A is a cross-sectional schematic representation of a clamshell portion 500 having a lipseal 502 supporting a substrate 509 prior to compressing a portion of lipseal 502, in accordance with certain embodiments. Lipseal 502 includes a flexible elastomeric support edge 503 comprising a sealing protrusion 504. The sealing protrusion 504 is configured to engage the semiconductor substrate 509, providing support, and forming a seal. Sealing protrusion 504 defines a perimeter for excluding a plating solution, and may have a first inner diameter (see FIG. 5A) defining the exclusion perimeter. It should be noted that the perimeter and/or first inner diameter may slightly change while sealing the substrate against the elastomeric lipseal due to deformation of the sealing protrusion 504.

Lipseal 502 also includes a flexible elastomeric upper portion 505 located above the flexible elastomeric support edge 503. The flexible elastomeric upper portion 505 may include a top surface 507 configured to be compressed, and also an inner side surface 506. The inner side surface 506 may be located outward relative to the sealing protrusion 504 (meaning that the inner side surface 506 is located further from the center of a semiconductor substrate being held by the elastomeric lipseal than the sealing protrusion 504), and be configured to move inward (towards the center of a semiconductor substrate being held) when the top surface 507 is compressed by another component of the electroplating clamshell. In some embodiments, at least a portion of the inner side surface is configured to move inward by at least about 0.1 mm, or at least about 0.2 mm, or at least about 0.3 mm, or at least about 0.4 mm, or at least about 0.5 mm. This inward motion may cause the inner side surface 506 of the lipseal to contact the edge of a semiconductor substrate resting on the sealing protrusion 504, pushing the substrate towards the center of the lipseal and thus aligning it within the electroplating clamshell. In some embodiments, the flexible elastomeric upper portion 505 defines a second inner diameter (see FIG. 5A) which is greater than the first inner diameter (described above). When top surface 507 is not compressed, the second inner diameter is greater than the diameter of the semiconductor substrate 509, so that the semiconductor substrate 509 may be loaded into the clamshell assembly by lowering it through the flexible elastomeric upper portion 505 and placing it onto the sealing protrusion 504 of flexible elastomeric support edge 503.

Elastomeric lipseal 502 may also have an integrated or otherwise attached contact element 508. In other embodiments, contact element 508 may be a separate component. In any event, whether or not it is a separate component, if contact element 508 is provided on inner side surface 506 of lipseal 502, then contact element 508 may also be involved in the aligning of the substrate. Thus, in these examples, if present, contact element 508 is considered to be a part of inner side surface 506.

Figure 5B:
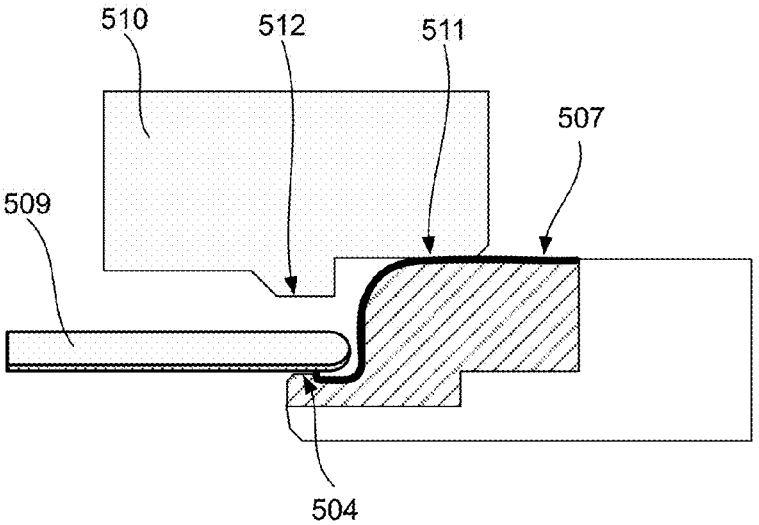
FIG. 5B is a cross-sectional schematic of the lipseal assembly of FIG. 5A with a surface of the cone of the clamshell assembly pressing on an upper surface of the lipseal assembly.

Compression of the top surface 507 of the elastomeric upper portion 505 (in order to align and seal the semiconductor substrate within the electroplating clamshell) may be accomplished in a variety of ways. For instance, top surface 507 may be compressed by a portion of the cone or some other component of the clamshell. FIG. 5B is a schematic representation of the same clamshell portion shown in FIG. 5A immediately prior to being compressed with cone 510, in accordance with certain embodiments. If cone 510 is used to press on top surface 507 of upper portion 505 in order to deform upper portion as well as to press on substrate 509 in order to seal substrate 509 against sealing protrusion 504, then cone may have two surfaces 511 and 512 offset with respect to each other in a particular way. Specifically, first surface 511 is configured to press top surface 507 of upper portion 505, while second surface 512 is configured to press on substrate 509. Substrate 509 is generally aligned prior to sealing substrate 509 against sealing protrusion 504. Therefore, first surface 511 may need to press on top surface 507 prior to second surface 512 pressing on substrate 509. As such, a gap may exist between second surface 512 and substrate 509 when first surface 511 contacts top surface 507, as shown in FIG. 5B. This gap may depend on necessary deformation of upper portion 505 to provide alignment.

In other embodiments, top surface 507 and substrate 509 are pressed by different components of the clamshell that may have independently controlled vertical positioning. This configuration may allow for independently controlling the deformation of upper portion 505 prior to pressing onto the substrate 509. For example, some substrates may have larger diameters than others. Alignment of such larger substrates may need and even require, in certain embodiments, less deformation than smaller substrates because there is a less initial gap between the larger substrates and inner side surface 506.

Figure 5C:
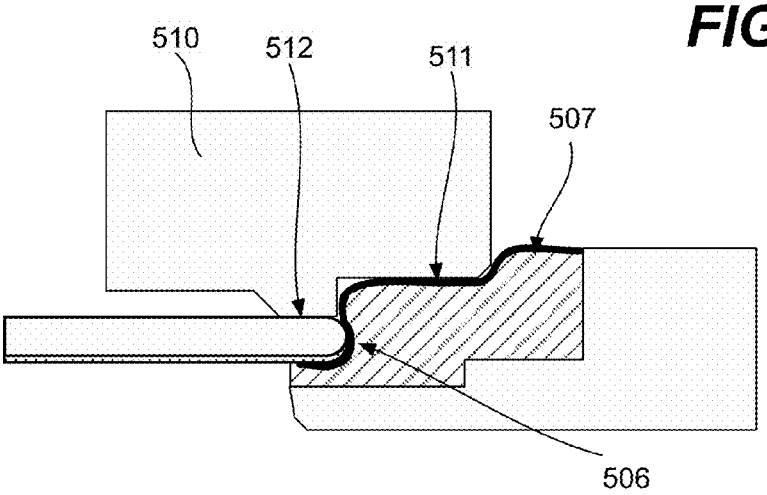
FIG. 5C is a cross-sectional schematic of the lipseal assembly of FIG. 5A and FIG. 5B with a surface of the cone of the clamshell assembly pushing on both an upper surface of the lipseal and on the semiconductor substrate.

FIG. 5C is a schematic representation of the same clamshell portion shown in FIG. 5A and FIG. 5B after the clamshell is sealed, in accordance with certain embodiments. Compression of top surface 507 of upper portion 505 by first surface 511 of cone 510 (or some other compressing components) causes deformation of upper portion 505 such that inner side surface 506 moves inwards, contacting and pushing on semiconductor substrate 509, in order to align semiconductor substrate 509 in the clamshell. While FIG. 5C illustrates a cross-section of a small portion of the clamshell, one of ordinary skill in the art would appreciate that this alignment process occurs simultaneously around the entire perimeter of substrate 509. In certain embodiments, a portion of the inner side surface 506 is configured to move by at least about 0.1 mm, or at least about 0.2 mm, or at least about 0.3 mm, or at least about 0.4 mm, or at least about 0.5 mm towards a center of the lipseal when the top surface 507 is compressed.

Methods of Aligning and Sealing a Substrate in a Clamshell

Figure 6:
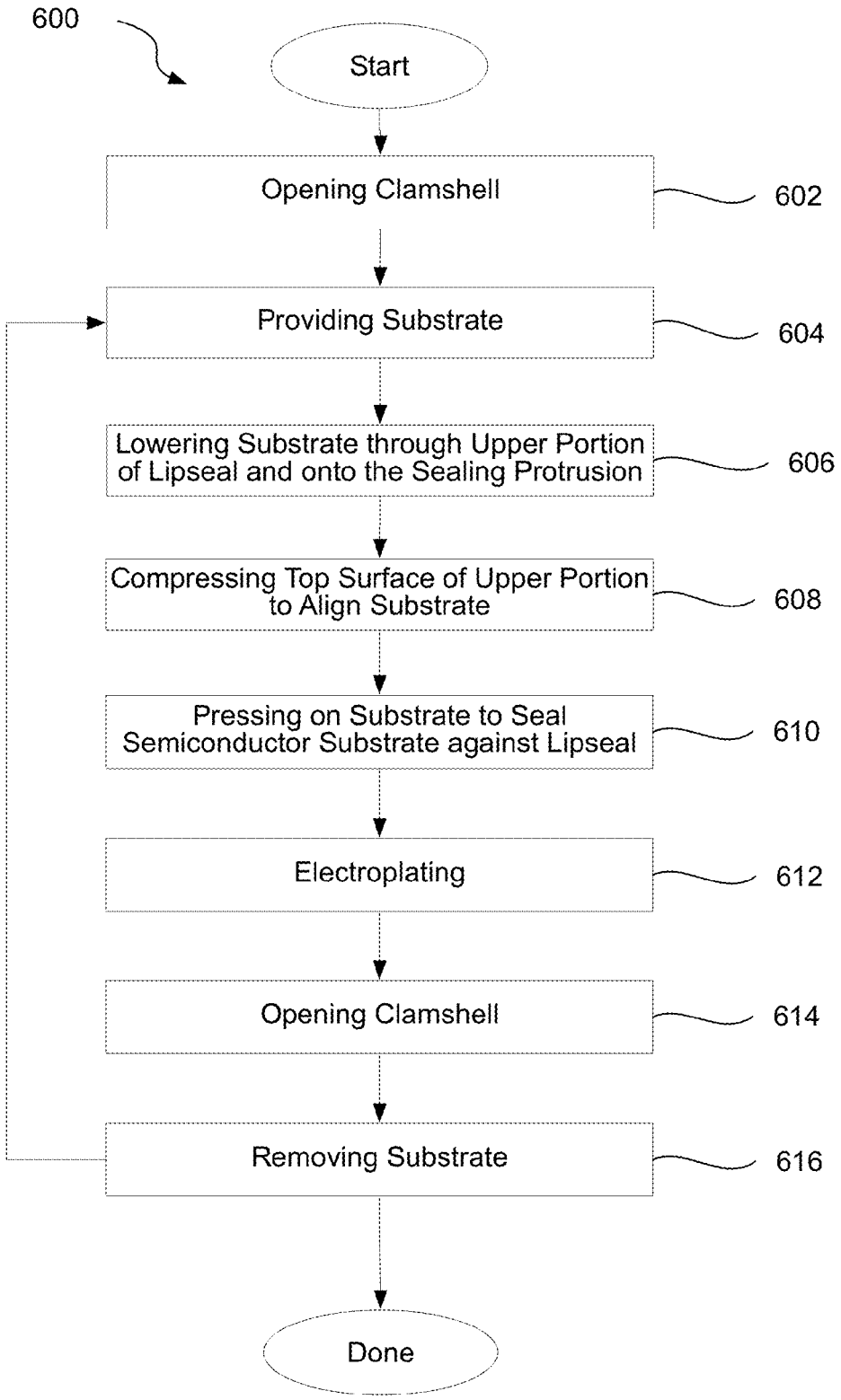
FIG. 6 is a flowchart illustrating a method of electroplating a semiconductor substrate.

Also disclosed herein are methods of aligning and sealing a semiconductor substrate in an electroplating clamshell having an elastomeric lipseal. The flowchart of FIG. 6 is illustrative of some of these methods. For instance, some embodiment methods involve opening the clamshell (block 602), providing a substrate to the electroplating clamshell (block 604), lowering the substrate through an upper portion of the lipseal and onto a sealing protrusion of the lipseal (block 606), and compressing a top surface of the upper portion of the lipseal to align the substrate (block 608). In some embodiments, compressing the top surface of the upper portion of the elastomeric lipseal during operation 608 causes an inner side surface of the upper portion to contact the semiconductor substrate and push on the substrate aligning it in the clamshell.

After aligning the semiconductor substrate during operation 608, in some embodiments, the method proceeds by pressing on the semiconductor substrate in operation 610 to form a seal between the sealing protrusion and the semiconductor substrate. In certain embodiments, compressing the top surface continues during pressing on the semiconductor substrate. For example, in certain such embodiments, compressing the top surface and pressing on the semiconductor substrate may be performed by two different surfaces of the cone of the clamshell. Thus, a first surface of the cone may press on the top surface to compress it, and a second surface of the cone may press on the substrate to form a seal with the elastomeric lipseal. In other embodiments, compressing the top surface and pressing on the semiconductor substrate are performed independently by two different components of the clamshell. These two pressing components of the clamshell are typically independently movable with respect to one another, thus allowing compression of the top surface to be halted once the substrate is pressed upon and sealed against the lipseal by the other pressing component. Furthermore, the compression level of the top surface may be adjusted based upon the diameter of the semiconductor substrate by independently altering the pressing force exerted upon it by its associated pressing component.

These operations may be part of a larger electroplating process, which is also depicted in the flowchart of FIG. 6 and briefly described below.

Initially, the lipseal and contact area of the clamshell may be clean and dry. The clamshell is opened (block 602) and the substrate is loaded into the clamshell. In certain embodiments, the contact tips sit slightly above the plane of the sealing lip and the substrate is supported, in this case, by the array of contact tips around the substrate periphery. The clamshell is then closed and sealed by moving the cone downward. During this closure operation, the electrical contacts and seals are established according to various embodiments described above. Further, the bottom corners of the contacts may be force down against the elastic lipseal base, which results in additional force between the tips and the front side of the wafer. The sealing lip may be slightly compressed to ensure the seal around the entire perimeter. In some embodiments, when the substrate is initially positioned into the cup only the sealing lip is contact with the front surface. In this example, the electrical contact between the tips and the front surface is established during compression of the sealing lip.

Once the seal and the electrical contact is established, the clamshell carrying the substrate is immersed into the plating bath and is plated in the bath while being held in the clamshell (block 612). A typical composition of a copper plating solution used in this operation includes copper ions at a concentration range of about 0.5-80 g/L, more specifically at about 5-60 g/L, and even more specifically at about 18-55 g/L and sulfuric acid at a concentration of about 0.1-400 g/L. Low-acid copper plating solutions typically contain about 5-10 g/L of sulfuric acid. Medium and high-acid solutions contain about 50-90 g/L and 150-180 g/L sulfuric acid, respectively. The concentration of chloride ions may be about 1-100 mg/L. A number of copper plating organic additives such as Enthone Viaform, Viaform NexT, Viaform Extreme (available from Enthone Corporation in West Haven, Conn.), or other accelerators, suppressors, and levelers known to those of skill in the art can be used. Examples of plating operations are described in more detail in U.S. patent application Ser. No. 11/564,222 filed on Nov. 28, 2006, which is hereby incorporated by reference in its entirety herein for all purposes, but in particular for the purpose of the describing plating operations. Once the plating is completed and an appropriate amount of material has been deposited on the front surface of the substrate, the substrate is then removed from the plating bath. The substrate and clamshell are then spun to remove most of the residual electrolyte on the clamshell surfaces which has remained there due to surface tension and adhesive forces. The clamshell is then rinsed while continued to be spun to dilute and flush as much of the entrained electrolytic fluid as possible from clamshell and substrate surfaces. The substrate is then spun with rinsing liquid turned off for some time, usually at least about 2 seconds to remove some remaining rinsate. The process may proceed by opening the clamshell (block 614) and removing the processed substrate (block 616). Operational blocks 604 through 616 may be repeated multiple times for new wafer substrates, as indicated in FIG. 6.

Cup Assemblies Having Improved Rigidity, More Precise Sealing Component Fabrication, and Reduced Tolerance Stack-Up Oftentimes, a cup-and-cone electroplating clamshell design makes use of an elastomeric lipseal which is manufactured separately from the other components of the clamshell—i.e., the lipseal is often manufactured as a distinct component for later incorporation into the clamshell when assembled for operational use. Primarily, this stems from the fact that the other clamshell components are generally not composed of elastomeric material—rather being rigid pieces made from metals or hard plastics—and so typically a separate molding or fabrication process would be used for them. However, because the lipseal is made of a flexible elastomeric material, and because of its thin (and perhaps delicate) shape (e.g., see FIG. 2 as described above and below), the molding of the lipseal may be less precise than the fabrication of the rigid clamshell components. Furthermore, the assembly process—mounting the lipseal in the bottom of the cup (the "cup bottom")—may lead to additional variations in the shape and dimension of the lipseal, as well as contribute additional variability through tolerance "stack-up." Per-wafer substrate profit margins oftentimes depend directly on a substrate's usable surface area; hence the size of a wafer's edge exclusion region—defined by the radial location of the seal made by the lipseal against the substrate—directly impacts the "bottom line" profitability associated with each wafer substrate. Nevertheless, the lipseal must seal the peripheral region of the substrate's surface (which is used for making electrical connection with a source of electroplating current) inward enough of the substrate's edge such that variability in manufacture of the lipseal and tolerance stack-up does not negatively impact the reliability of the lipseal's sealing capability. Thus, it is important that the elastomeric sealing element be designed and manufactured as precisely as reasonably feasible.

Current approaches to cup assembly and sealing component manufacture may be improved upon by manufacturing the elastomeric sealing element in conjunction with the manufacture of the cup bottom element of the cup assembly of an electroplating clamshell design. In other words, it may be beneficial to fabricate the cup assembly, and in particular, the cup bottom element and elastomeric sealing element in an integrated fashion. One way of accomplishing this is to mold the elastomeric sealing element directly to (onto, over, etc.) the cup bottom element. This may be particularly effective if the elastomeric sealing element is physically smaller—for example, having a radial profile more local to the wafer edge region as opposed to extending too far radially outward into the cup assembly as in more conventional designs—the smaller sized sealing element being easier to form in place on the cup bottom element. However, it is also to be noted that in some embodiments a smaller sized elastomeric sealing element may allow integrated manufacture with the cup bottom via bonding, gluing, adhering with an adhesive, or otherwise affixing the sealing element to the cup bottom element in a precisely controlled manner so as to achieve the benefits described above, despite the elastomeric sealing element not being directly molded into the cup bottom element. In either case, integrated manufacture of an elastomeric sealing element having a reduced radial profile with the cup bottom element may enable the former to be more precisely manufactured and located within the cup bottom and thus reduce the size of a wafer substrate's edge exclusion region relative to other designs.

Figure 2:
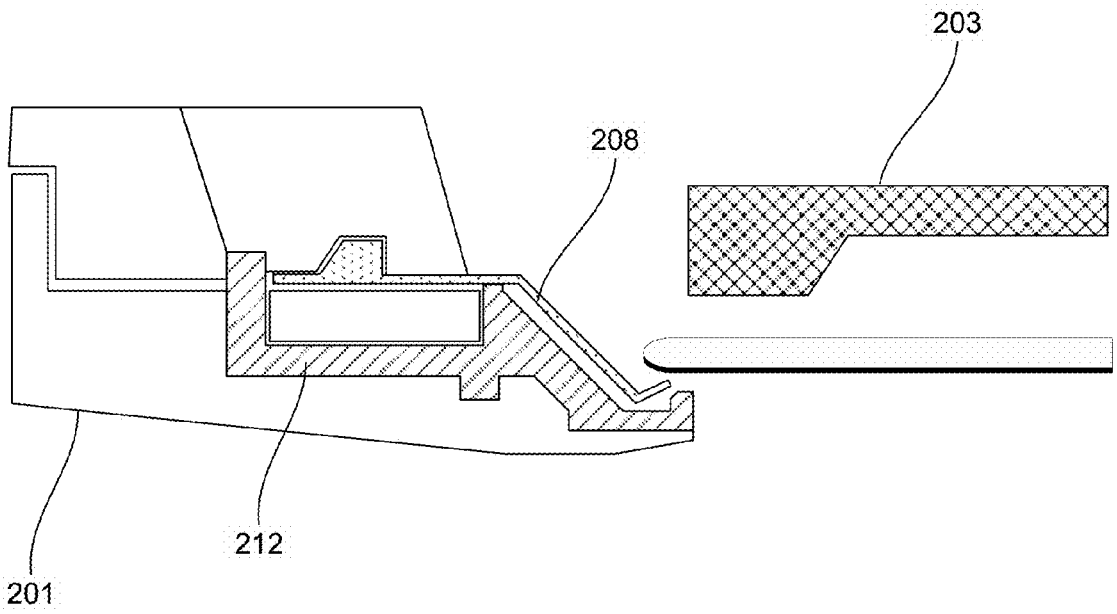
FIG. 2 is a cross-sectional schematic of a clamshell assembly having contact rings made with multiple flexible fingers.

An elastomeric sealing element manufactured in integrated fashion with the cup bottom may also employ substrate electrical contact elements which are different than those often used in other cup assembly designs. For instance, cup assemblies using a separately manufactured lipseal may employ contact fingers as contact elements which are made of hardened sheet metal (e.g., about 0.0005 to 0.005 inches thick) that flex and form a point or line electrical contact with the substrate upon closing of the clamshell. Such contacts may have an "L" shape at the contacting ends, and they may act as cantilevers. An example of such an embodiment is schematically illustrated in FIG. 2. FIG. 2 shows contact fingers 208 ready to flex and form point or line electrical contacts with the displayed substrate upon lowering of the cone 203 (i.e., closing of the clamshell). However, the flexing of the contact fingers, such as contact fingers 208 in FIG. 2, may cause a radial variation in the points or lines of electrical connection they form with the substrate. Variation may also be due to tolerance stack up between the various components of the electroplating clamshell design shown in FIG. 2—variation in the fabrication of lipseal 212, it's positioning in cup 201, orienting of the contact fingers 208 on the lipseal 212, and flexing of the contact fingers 208 to contact the substrate.

The cup assemblies disclosed here which have integrated elastomeric sealing elements may employ electrical contact elements of a different sort having different features. Rather than use L-shaped contact fingers formed from hardened sheet metal and angled as cantilevers as illustrated in FIG. 2, these cup assemblies may employ a generally flat contact element made from a non-hardened thin flat sheet metal material disposed atop a portion of the elastomeric sealing element. Such an electrical contact element may be thin enough and soft/flexible enough to deform slightly against pressure from the substrate as it is pressed against the elastomeric sealing element beneath it by the cone. In some embodiments, the contact element may deform to an extent that it even conforms (or somewhat conforms) to the shape of the substrate, upon such pressure from the substrate as the contact element is sandwiched between the substrate and the sealing element. In some embodiments, the soft flexible sheet metal contacts may deform enough to conform to the bevel region of the wafer. Thus, the electrical contact force is provided by compression of the elastomeric sealing element underneath the contact element rather than by the spring force of hardened sheet metal as in the cantilever contact finger design shown in FIG. 2.

An example of such a cup assembly having these and various other features is schematically illustrated in FIGS. 7A through 7I. The illustrated cup assembly 700 includes a flexible and flat electrical contact element 705 that may conform to the shape of the edge of the substrate such as the bevel region of a wafer substrate. This electrical contact element is shown in the figures to be deposed atop an elastomeric sealing element 703 which is integrated to the cup bottom element 701. The elastomeric sealing element may be molded in (or into or onto, etc.) the cup bottom element or otherwise bonded/affixed to the cup bottom element during the manufacturing of the cup assembly, as described above. This cup assembly design thus has certain features which are different than the designs shown in FIGS. 2-5 discussed above, and the design described with respect to (and shown in) FIGS. 7A through 7I may be viewed as an alternative embodiment to the cup assembly designs shown above.

Generally, FIGS. 7A-C are cross-sectional and isometric views of a cup assembly 700 with the aforementioned integrated elastomeric sealing element 703. Each of the figures presents a schematic of cup assembly 700 having a cup bottom element 701 with an elastomeric sealing element 703 and an electrical contact element 705. In particular, FIG. 7A shows a broad cross-sectional view of an annular slice through these elements, and FIG. 7B shows a magnified portion of the view shown in FIG. 7A, focusing in on the details of the part of the cup bottom element which supports the elastomeric sealing element 703 and electrical contact element 705. Likewise, FIG. 7C shows a perspective view of the portion of the cup assembly magnified in FIG. 7B. It should be appreciated from the annular slices shown in these figures that each of the cup bottom, elastomeric sealing, and electrical contact elements are generally ring-shaped. Because of this, the elastomeric sealing element, for example, may be referred to herein as an elastomeric ring, and likewise, the electrical contact element may be referred to herein as a contact ring, but it should of course be appreciated that these elements, though ring-shaped, may have an angular dependence to their design, such as the contact fingers of the contact ring 705 having fingers 706 as shown in FIG. 7F (described in greater detail below). Each of these figures also show a substrate 731 being pushed into sealing element 703 by cone 727, as well as bus bar 721—which may also be referred to herein as a bus ring—which provides electrical power to contact element 705 during electroplating.

The broader view of the cup assembly presented in FIG. 7A illustrates that a bolt 723 may extend through the electrical bus bar (or ring) 721 to affix the bus bar to the cup bottom element 701 of cup assembly 700. FIG. 7A also illustrates that included in the cup assembly may be a ring-shaped insulating element 725 which circumscribes the outer edge of the cup assembly. The ring-shaped insulating element 725 prevents the conductive bus bar 721 from contacting electrolyte.

The magnified views of cup assembly 700 presented in FIGS. 7B and 7C more specifically focus on the cup bottom element 701, as well as it's elastomeric sealing element 703 and electrical contact element 705. Contact of the sealing element 703 with substrate 731 is also illustrated. Again, it should be appreciated that the features depicted in cross-section in FIGS. 7A-C are part of an annular structure, and the cross-section is taken through a radial slice. FIGS. 7B (in close-up) and 7C (in further perspective view) depict the semiconductor substrate 731 resting in cup assembly 700 with cone 727 contacting the backside of the substrate. Thus, these figures depict both the cup and cone features of a clamshell-type substrate holder design with a substrate loaded and ready to make electrical contact with the substrate. It is seen from the close-up views of FIGS. 7B and 7C that cone 727 is in position contacting the backside of semiconductor substrate 731 ready to press against it and to apply pressure sufficient to push the substrate into physical contact with the electrical contact element 705. It is also seen in FIGS. 7B and 7C that the elastomeric sealing element 703 will compress just slightly in order for this electrical contact to be made.

FIGS. 7B and 7C illustrate that cup bottom element 701 includes a main body portion 711 and a moment arm 713. The moment arm 713 is a relatively thin extension (radially-inward) of the main body of the cup bottom element 701 which serves to support the elastomeric sealing element 703 as well as the electrical contact element 705 disposed on the sealing element. Since it supports these elements, and since it is relatively thin, the moment arm 713 may flex (hence the name) to a certain degree in response to the pressure exerted by cone 727 when the substrate is pressed against by the cone into it's sealing and electrical contact arrangement.

In contrast, the main body portion 711 of cup bottom 701 is designed to be relatively thick (much thicker than the moment arm 713). As a result, the main body portion may be such that it does not substantially flex when the semiconductor substrate is pressed against the moment arm. Furthermore, not only is the main body portion of the cup bottom element rigid in itself, in some embodiments, the main body portion may also be designed such that it is rigidly affixed to another feature of the cup structure. For instance, in the embodiment shown in FIG. 7A, bolt 723 rigidly affixes cup bottom 701 to the bus bar/ring 721, so that the main body portion 711 remains substantially fixed and rigid with respect to the other rigid portions of the cup assembly 700.

Accordingly, the main body portion of the cup bottom element remains substantially rigid during operation and resists any flexing when force/pressure from cone 727 is transmitted to it through the substrate 731, the contact element 705, the sealing element 703, and ultimately through the moment arm 713. On the other hand, upon sufficient application of pressure to the substrate, the moment arm 713 is designed to be the component of the cup bottom 711 that flexes. The moment arm, however, may still be designed to be as short as possible so that it doesn't exhibit too much flex while still providing a radially sufficient horizontal surface to support the electrical contact element 705 and elastomeric sealing element 703. (Compare in FIG. 7A, for example, the relative sizes and thicknesses of the cup bottom's main body portion 711 to its moment arm 713.)

FIGS. 7B and 7C illustrate in detail the geometry of the engagement between substrate 731 and elastomeric sealing element 703 and also engagement with contact element 705. For instance, the figures illustrate that the radially innermost point of contact (more particularly, ring of contact) is between the substrate 731 and sealing element 703 which defines a peripheral region of the substrate where plating solution is substantially excluded and where electrical contact is to be made. Sufficient pressing (by the cone 727) of the substrate 731 into the sealing element 703 compresses the sealing element to form the liquid-tight seal, and also causes the sealing element 703 to deform sufficiently such that contact is made with electrical contact element 705 just radially outward of the contact with the seal.

In addition, as mentioned, this pressure from the substrate 731 may also cause the portion of the elastomeric seal 703 underneath the contact element 705 to compress and produce a countervailing elastic force beneath the contact element which causes the contact element to flex and conform to the shape of the portion of the substrate contacting it. In particular, in some embodiments, when the elastomer underneath the contact element is compressed, the contact element may flex and adjust its shape so as to conform to the profile of the edge bevel region of the substrate. Once again, this feature may be promoted by the contact element being relatively thin and made from a flexible conductive material (as opposed to a hardened metal which exhibits spring-like behavior).

Details Regarding the Cup Bottom Element

As mentioned, the cup bottom element 701 resists significant flexing, aside from the small moment arm, when the wafer is pushed down. This may be because the cup bottom element 701 has a relatively thick main body portion 711 and a relatively short and thin moment arm 713 upon which the sealing element 703 is disposed upon.

The cup bottom element 701 may be generally ring-shaped and sized to accommodate semiconductor substrates of standard size, such as 200 mm, a 300 mm wafers or 450 mm wafers. The inner edge of the cup bottom element—or more specifically moment arm 713 in FIGS. 7A-7C—engages the outer periphery of the substrate (731 in FIGS. 7A-7C), although typically it does not actually touch the substrate. Instead, as described above, it is the elastomeric sealing element and electrical contact element that make physical contact with the substrate. In some embodiments, the cup bottom element is designed to provide an exclusion region of about 1 mm or less. The exclusion region is the peripheral region of a substrate's surface from which electroplating/electrolyte solution is substantially excluded from contacting during an electroplating operation.

As explained and shown in FIGS. 7A-7C, the cup bottom element 701 includes a main body portion 711 and a moment arm 713. Together these elements may form a monolithic structure. In other words, the separate labeling of these elements as described herein should not be taken to imply that these elements—the main body portion and the moment arm—are necessarily two physically distinct and separately fabricated components which are joined together to form the cup bottom element. Though it is feasible that they be distinct and then joined together, more typically, the main body portion of the cup bottom and the moment arm are fabricated as one element (e.g., without a bond, seam, etc. joining them). Rather than implying separate fabrication and later joining, the labeling of these portions of the cup, and more particularly, the cup bottom as "moment arm" and "main body portion" is done to emphasize that they behave differently as a result of pressure being applied to the cup by the cone (through the pressing against it by the substrate). That is, as stated above, the moment arm is thin and designed to flex somewhat upon applied pressure, whereas the main body portion is thick and designed to remain substantially rigid.

Figure 7D:
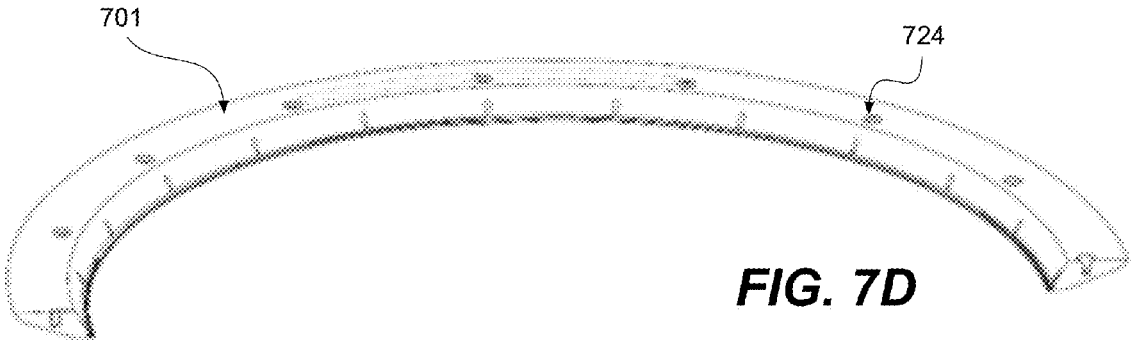
FIG. 7D presents an expanded perspective view of a substantial annular portion of the cup assembly shown in FIGS. 7A-7C.
Figure 7E:
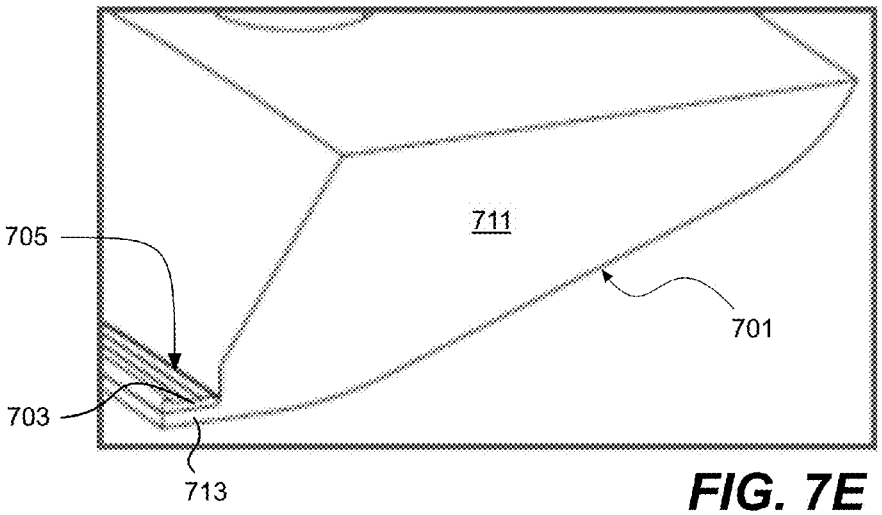
FIG. 7E presents a magnified perspective view of the cup assembly shown in FIG. 7D showing the cross-section of the annular portion.
Figure 7F:
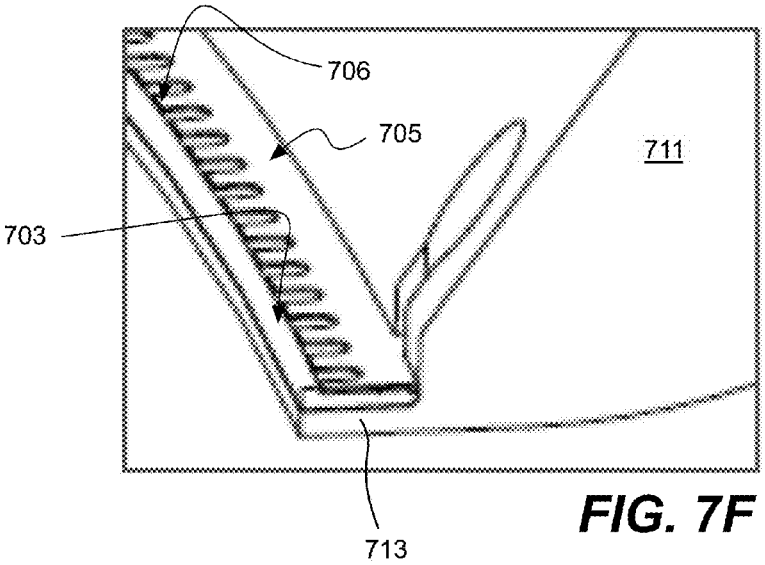
FIG. 7F presents a further magnified perspective view of the cup assembly shown in FIGS. 7D-7E.

Other detailed views of the cup bottom element are shown in FIGS. 7D through 7I. These figures show the cup bottom element 701, along with elastomeric sealing element 703 and electrical contact element 705, separate from the other components of the cup assembly 700 (and cone 727) shown in FIGS. 7A-7C. For instance, FIG. 7D shows, separately from the other cup assembly components, a perspective view of a cup bottom element, or more precisely a view of about half of an entire cup bottom element 701 sliced approximately through it's center axis thereby illustrating an annular region of about 180 degrees—i.e., about half the circumference of the cup bottom. Thus, the view illustrates the cup bottom element's generally ring-shaped structure. The view also shows bolt holes 724 which may be used to attach this particular cup bottom structure to the rest of the cup assembly 700—such as by the bolts 723 as shown in FIG. 7A. As also shown in FIG. 7A, in this particular embodiment, the cup bottom element 701 is designed to be bolted to the electrical bus bar 721. Other mechanisms of joining the cup bottom element to the cup assembly are also envisioned such as an engagement mechanism employing clips for clipping the cup bottom to the rest of the cup assembly, or using an adhesive to bond the cup bottom to the rest of the cup assembly.

FIG. 7E shows a magnified view of FIG. 7D, focusing in on the cup bottom element's cross-section from FIG. 7D, again separately from the other components of the cup assembly and representing a slice down the cup bottom's center axis, and the view is further magnified in FIG. 7F, focused in specifically on moment arm 713 (with elastomeric seal 703 and contact element 705 upon it). These views show the extension of the moment arm 713 radially inward from the rest of the cup bottom element as well as the placement of the elastomeric sealing element 703 and electrical contact element 705 disposed thereon. The view in FIG. 7E also illustrates the relative proportions of the cup bottom element's moment arm 713 and main body portion 711. It is seen again that the moment arm 713 is indeed much smaller than the main body portion 711—both radially, and in terms of its height (i.e., thickness in the vertical direction). Depending on the embodiment, the radial width of the moment arm—the horizontal distance between it's radial inward (distal) tip and the point at which it joins the main body portion of the cup bottom element—may be at most about 0.3 inches, or at most about 0.1 inches, or in certain embodiments, between about 0.04 and 0.3 inches. Note that the radial width of the moment arm should be designed to meet the exclusion region requirements. Therefore, it should, in certain embodiments, be at least as long as the exclusion area (e.g., at least 1 mm).

The design of the moment arm is generally such that it accommodates substantially all of the deflection of the cup bottom element during placement of a semiconductor substrate onto the cup. Thus, in certain embodiments, the moment arm has a thickness—the distance between the top and bottom of the moment arm in the direction of wafer insertion (i.e., its vertical height in FIG. 7A) in the thinnest section of the moment arm—of between about 0.010 and 0.1 inches, or more particularly between about 0.015 and 0.025 inches.

This vertical height/thickness may be quite thin relative to the thickness of the main body portion of the cup bottom element, as well-illustrated in FIG. 7E, since while the moment arm may flex, the main body portion may be designed to remain substantially rigid and/or resisting deflection and/or deformation when the substrate is pushed against the sealing element and moment arm by the cone. Thus, whereas the moment arm may generally take the shape of a flat ring-shaped horizontal surface, the main body portion is generally substantially thicker in the vertical direction and may assume a generally trapezoidal and/or polygonal shape, and/or a shape having curved surfaces cross-sectionally. Resistance to deflection and/or deformation may also be enhanced by fabricating the cup bottom element 701 out of strong rigid materials.

Moreover, in certain embodiments, the main body portion may have a maximum thickness (vertical height, top to bottom, perpendicular to the radially direction) of at least about 0.2 inches, or more particularly at least about 0.3 inches; in some embodiments, it may have a maximum vertical height of between about 0.2 and 1 inches. In terms of average vertical height/thickness, in certain embodiments, the main body portion may have an average vertical height of at least about 0.1 inches, or at least about 0.3 inches, or at least about 0.5 inches, or even more particularly at least about 1.0 inch. In some embodiments, the average vertical height of the main body portion may be between about 0.1 and 1.0 inches, or more particularly between about 0.2 and 0.5 inches.

Moreover, depending on the embodiment, the ratio of the average vertical height/thickness of the main body portion of the cup bottom element to the average vertical height/thickness of the moment arm may be greater than about 3, or more particularly said ratio may be greater than about 5, or even more particularly greater than about 20, depending on the embodiment.

Likewise, the radial width of the main body portion of the cup bottom element may be between about 0.5 and 3 inches or between about 0.75 and 1.5 inches. Generally, it is advantageously sized to allow rigid structural integration with the other elements of the cup.

It is also seen in FIG. 7E that, in certain embodiments, the main body portion 711 of cup bottom element 701 abruptly tapers (radially inward) to the point where it contacts the moment arm 713. In other words, as shown in FIG. 7E, in some embodiments, the cup bottom element 701 tapers immediately over a relatively short distance (radially inward) from a thick section of the main body portion 711 to the flat structure of the moment arm 713. In certain embodiments, the taper from the thickest section of the main body portion 711 to the moment arm 713 is over a distance of less than about 0.5 inches, or more particularly less than about 0.1 inches, or between about 0.1 and 0.5 inches. Furthermore, and as further shown in FIGS. 7A and 7E, in the particular illustrated embodiment, most of the main body portion 711 is located vertically above the moment arm 713.

Thus, the moment arm 713 may be viewed as extending inward towards the substrate from the main body portion 711 of the cup bottom element 101 and therefore, in some embodiments, it may further be viewed as operating in cantilever fashion to physically support the edge of the substrate as it is received into the cup prior to an electroplating operation (as well as during the electroplating operation itself).

In addition to physically supporting the substrate, the moment arm supports the sealing element and appropriately locates it relative to the edge of the substrate so as to establish a leak tight seal, thereby forming the aforementioned electrolyte exclusion region near the substrate's edge.

Thus, the moment arm may be shaped to accommodate a ring-shaped sealing element which typically sits between the moment arm and the wafer during operation, such as ring-shaped sealing element 703 shown in the figures. In certain embodiments, the moment arm has a substantially straight or linear horizontal shape, without significant vertical features. In certain embodiments, the moment arm and the adjacent (radially outward) portion of the main body section of the cup bottom is shaped to form a mold for forming the elastomeric sealing element directly in the cup bottom—such as via molding through precursor polymerization (as described further below).

The material from which the cup bottom element is formed is typically a relatively rigid material. Furthermore, it may be made from a conductive or insulating material. In some embodiments, the cup bottom element is made from a metal such as titanium, or a titanium alloy, or stainless steel. In some embodiments, if it is made from a conductive material, the conductive material may be coated with an insulating material. In other embodiments, the cup bottom element is made from a non-conductive material such as a plastic such as PPS or PEEK. In other embodiments, the cup bottom is made from a ceramic material. In certain embodiments, the cup bottom element has a rigidity characterized by a Young's modulus of between about 300,000 and 55,000,000 psi, or more particularly between about 450,000 and 30,000,000 psi.

Details Regarding the Sealing Element (Lipseal)

Generally, the elastomeric sealing element is a ring-shaped element that fits snugly on top of the moment arm and, optionally, against the inner radial edge of the main body portion of the cup bottom. In certain embodiments, the sealing element has a radial width of about 0.5 inches or less, or about 0.2 inches or less, or between about 0.05 and 0.2 inches, or between about 0.06 and 0.10 inches. The overall radial width would generally be chosen sufficient to accommodate the wafer edge exclusion region associated with use of the apparatus. Likewise, the diameter of the elastomeric sealing element would generally be chosen appropriately for accommodating a standard wafer substrate such as a 200 mm, a 300 mm wafer or a 450 mm wafer.

The vertical thickness of the elastomeric sealing element may be between about 0.005 and 0.050 inches, or more particularly between about 0.010 and 0.025 inches. The thickness and shape of the sealing element may be chosen to facilitate substantially continuous contact between the sealing element and the substrate edge in order to form a substantially leak-tight seal between the sealing element and the substrate.

In certain embodiments, the sealing element has an L-shape (or a substantially L-like shape), where the small arm of the "L" extends upward at the inner radius of the sealing element. See, for example, FIGS. 7B and 7C, showing that for this particular embodiment, the sealing element 703 has a small upward protrusion 704 on it's radially innermost portion, which is radially inward of the substantially horizontal portion of the sealing element upon which the electrical contact element is disposed and vertically above said substantially horizontal portion of the sealing element (before the protrusion compresses when pressed against by the wafer substrate as described below).

This small upward protrusion may engage with the wafer to provide a leak-tight seal. It can be seen in this example shown in FIGS. 7B and 7C that compression of this upward protrusion 704 will not only create a leak-tight seal radially inward of the electrical contact element 705, but the compression of the upward protrusion will enable contact between the edge of the substrate and the electrical contact element 705. In some embodiments, this contacting may be aided by the flexing, or defection of, or cantilever-like movement of the moment arm itself. In certain embodiments, depending on the degree of the sealing element's compression, it's geometry, as well as the geometry of the electrical contact element and any flex associated with the moment arm, compression of the upward protrusion (possibly along with flex/deflection of the moment arm) may allow the electrical contact element to contact the edge bevel region of the substrate. In addition, in embodiments wherein the elastomeric sealing element underlies the electrical contact element, compression of the portion of the sealing element beneath the contact element may allow the contact element to deform to the shape of the wafer substrate such as, for example, conforming of the contact element to the shape of the radial profile of the edge bevel region of the wafer substrate. Depending on the embodiment, the vertical height of the aforementioned upward protrusion of the sealing element (e.g., for an L-shaped or L-like shaped elastomeric sealing element) may be between about 0.005 and 0.040 inches, or more particularly, between about 0.010 and 0.025 inches.

The Electrical Contact Element

The electrical contact element is made from a conductive material so that it can provide electrical current to the substrate during electroplating operations. Typically, the conductive material would be some sort of metal, alloy, etc. and it would be shaped and sized to sit on the upper surface of the moment arm, typically on top of the sealing element, but radially outward of the portion of the sealing element which forms the substantially leak-tight seal with the substrate. Such a configuration is illustrated in FIGS. 7B and 7C. In certain embodiments, the contact ring is made from a flexible and/or deformable metal or other flexible and/or deformable conductive material that is substantially flat so there it contacts the wafer seed layer over a relatively large contact area. Moreover, in some embodiments, locating/disposing a flat thin flexible contact element on top of a portion of the elastomeric sealing element may allow the contact element to deform slightly when the substrate is pressed upon it, and conform to the portion of the substrate surface contacting it—forming a conformal contact surface. This conforming to the shape of the substrate surface contacting it—e.g., conforming to the profile of the edge bevel region of the substrate—may be enhanced by the opposite compressive force (upward force) exerted on the contact element by the portion of the elastomeric sealing element beneath it. As a result, the quality, consistency, and/or uniformity of the electrical connection between the substrate and electrical contact element may be enhanced.

In some embodiments, the electrical contact element may be flat and thin but may be formed into contact fingers which are oriented so that they point radially inward around the contact element's circumference. The contact fingers may aid in improving the quality, consistency, and/or uniformity of the electrical connection by being more vertically deformable/flexible when pressure is exerted on them by the substrate than if a solid strip of conductive material (even if thin and flat) was employed (thought in some embodiments, the latter would also be suitable for providing the requisite electrical connection).

Figure 7G:
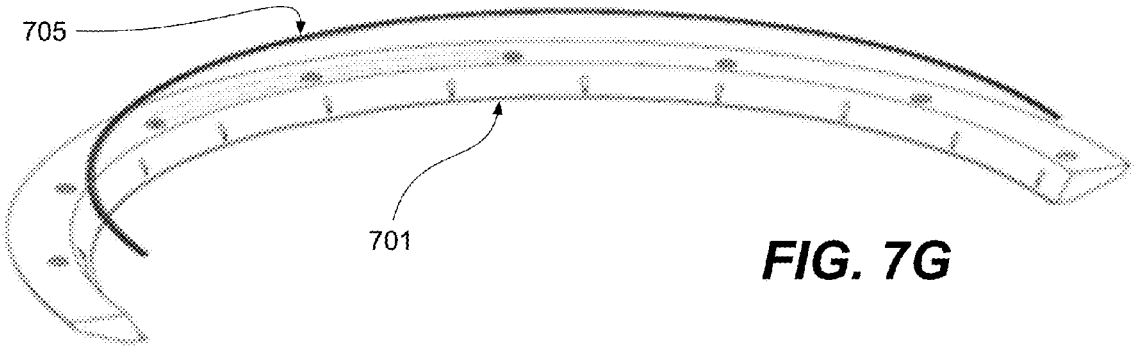
FIGS. 7G-7I present exploded views analogous to the perspective views shown in FIGS. 7D-7F but showing the contact ring element separated (vertically) from the remainder of the cup assembly.
Figure 7H:
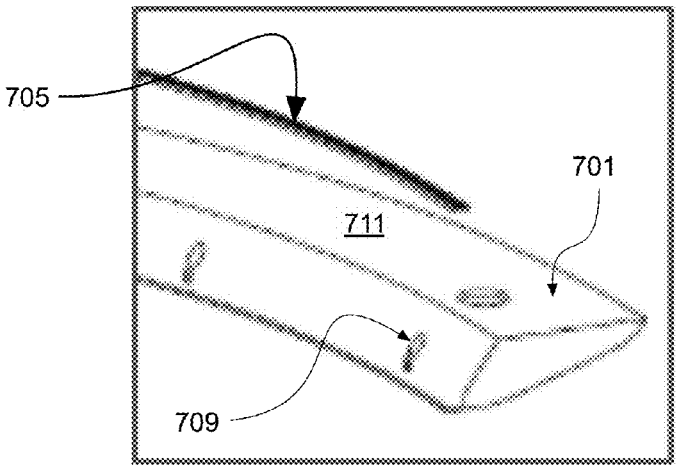

As mentioned above, the electrical contact element is generally substantially radially symmetric and ring-shaped so that it may symmetrically contact the substrate being electroplated, and particularly symmetric over the portion of its surface that contacts the substrate. For this reason, it may also be referred to herein as a contact-ring. The radial shape of an example contact-ring is illustrated in the exploded view of the cup bottom element 101 shown FIGS. 7G through 7I, which are analogous to the non-exploded views of the cup bottom element shown in FIGS. 7D-7E. In the later figures—FIGS. 7G-7I—the electrical contact element 705 is shown separated from the cup bottom element 101 so its shape can be distinguished. FIG. 7G, in particular, shows about half of the ring-shaped structure of an example electrical contact element 705 vertically separated from the remainder of cup bottom element 701. FIG. 7H magnifies one end of the cross-sectional slice through cup bottom element shown in FIG. 7G, and FIG. 7I a further magnified view focusing in on the cup bottom element's cross-section, again, with electrical contact ring 705 separated from cup bottom element 701.

From these figures, one notes that the radially symmetry of the contact ring 705 may be broken outward of the actual substrate contact portion of the ring with likely less impact on its operation, since the radially outward portion isn't forming the electrical connection to the substrate. This is seen in the exploded view of the cup bottom element in FIG. 7I where the contact ring 705 is seen to have a securing element 707 which fits into groove 709 of cup bottom element 701 when assembled for operation. One also notes that even the radially inward portion of the contact ring which does contact the substrate is only generally radially symmetric since, for example, the presence of electrical contact fingers break the symmetry over small angles. These contact fingers are shown in FIG. 7I, and even more clearly shown in FIG. 7F.

The electrical contact element/ring 705 has a diameter that accommodates the outer region of a seed layer on a standard semiconductor wafer substrate such as a 200 mm, a 300 mm wafer or a 450 mm wafer. It may be sized to lay flat on top of the sealing elastomer member 703. In certain embodiments, it may have a radial width of about 0.500 inches or less, or between about 0.040 and 0.500 inches, or more particularly between about 0.055 and 0.200 inches. The radial width of the contact ring is defined as the distance in the radial direction from the contact ring's outer radial edge to its inner radial edge, for example, defined by the radially inward extent of the contact fingers shown on the contact ring in FIGS. 7F and 7I. The vertical thickness of the contact ring is typically between about 0.0005 and 0.010 inches, or more particularly between about 0.001 and 0.003 inches.

Figure 7I:
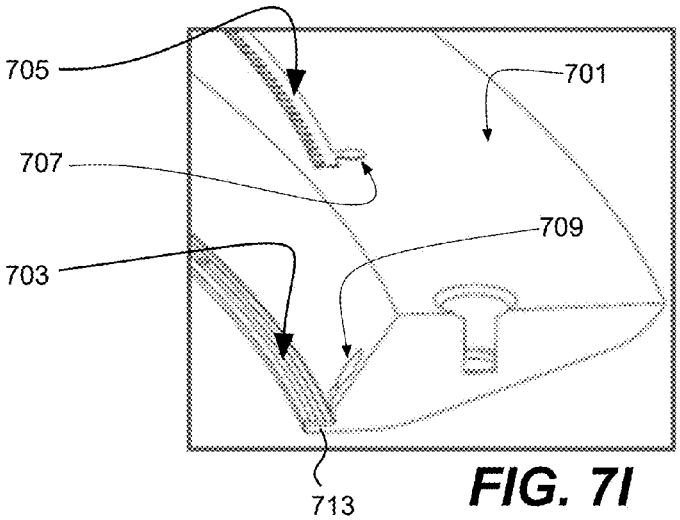

In certain embodiments, such as the example embodiment shown in FIGS. 7F and 7I, the contact ring has a plurality of radially inwardly projecting fingers for contacting the edge of a substrate when held in the cup bottom. These fingers may have a radial width of between about 0.01 and 0.100 inches or more particularly between about 0.020 and 0.050 inches. The contact fingers may have a center-to-center pitch of between about 0.02 and 0.10 inches or between about 0.04 and 0.06 inches. In certain embodiments, the pitch is invariant around the circumference of the contact ring. In other embodiments, the pitch may vary over the circumference of the contact ring. The pitch may be determined at the inner circumference of the contact ring. For contact fingers which rest flat upon the elastomeric sealing element, their pitch may be determined by the angle of the surface of the elastomeric sealing element.

In certain embodiments, the contact ring is substantially flat and it may lie substantially flat on the elastomeric sealing element, which itself may lie flat upon the moment arm. This design should generally be distinguished from designs in which the contact ring has an L-shaped structure with the small leg of the L extending upward to contact the substrate, and also from designs employing cantilever-like contact-fingers such as those shown in FIG. 3A. In these designs employing contact fingers which lie substantially flat atop the elastomeric sealing element, it is believed that (in some embodiments) improved electrical contact with the outer perimeter of the wafer seed layer may be achieved. Since the contact ring is substantially flat, any extra tolerance stack-up requirement resulting from variation in the degree of bending of cantilever-like contact fingers, for example, is eliminated. Thus, with a substantially flat electrical contact element, the electrical contact patch between it and the substrate surface may be more precisely located and controlled, and therefore a design may be employed locating the contact patch closer to the edge of the substrate. This in turn enables employment of a sealing element defining a more radially outward peripheral region (on the substrate surface from which electroplating solution is substantially excluded) such that a smaller edge exclusion distance may be achieved during electroplating operations.

While the contact ring is shown to be completely flat in FIGS. 7A-7I, in some embodiments a contact element which is substantially flat over the radially inward portion which contacts the wafer, may have a radially outward angled portion, for example, for making contact with a bus bar. Nevertheless, it may be in such embodiments that the portion of the contact ring which resides on the moment arm is still substantially flat. There may also be a slight pitch to the contact fingers of the contact element, as described above, though it still may be said that the contact element, and its contact fingers, generally lie substantially flat atop the elastomeric sealing element.

The electrical contact element/ring may be made from a relatively flexible conductive material that can bend and/or deform to accommodate the shape of the substrate and the underlying elastomeric sealing element when the substrate is pressed against the moment arm during (or prior to) an electroplating operation. For instance, the electrical contact element/ring may be made from thin non-hardened sheet metal. Thus, the portion of the contact element which contacts the substrate may be a thin sheet of flexible and/or deformable metal about 0.01 inches thick or less, or more particularly about 0.005 inches thick or less, or even about 0.002 inches thick or less. The metal comprising the contact ring may comprise stainless steel. In some embodiments, the metal may comprises a precious metal alloy. Such alloys may include alloys of palladium, including palladium-silver alloys optionally containing gold and/or platinum. Palinery 7 made by DERINGER-NEY INC is an example.

Integrated Manufacturing of the Cup Assembly and the Elastomeric Sealing Element Whereas oftentimes the elastomeric sealing element used to seal a substrate in an electroplating clamshell is a separate component which is user-installed into the clamshell prior to an electroplating operation, in various embodiments disclosed herein the cup assembly and its sealing element are integrated during the manufacturing process. In such cases, the elastomeric sealing element may be affixed to the cup bottom element during manufacturing by adhesion, molding, or another suitable process which inhibits the uncoupling of the elastomeric sealing element from the cup bottom element. As such, the elastomeric sealing element may be viewed as a permanent feature of the cup assembly rather than as a separate component.

In some embodiments, the elastomeric sealing element may be formed in situ inside the cup bottom element, for instance, by molding it directly into the cup bottom element. In this approach, a chemical precursor to the elastomeric material comprising the formed sealing element is placed in the location of the moment arm where the formed sealing element is to reside, and then the chemical precursor is processed so as to form the desired elastomeric material—such as by polymerization, curing, or other mechanism that converts the chemical precursor material into the formed elastomeric material having the desired final structural shape of the sealing element.

In other embodiments, the sealing element is pre-formed into its desired final shape and then integrated with the rigid (plastic or metal) cup bottom element during the manufacture of the cup assembly by affixing the sealing element to the appropriate location on the cup bottom element's moment arm via adhesive, glue, etc. or some other appropriate affixing mechanism.

Through integrated manufacture of the cup assembly with its elastomeric sealing element, the sealing element can be formed more precisely into its desired shape, and positioned more precisely within the structure of the cup bottom element of the cup assembly than what is generally achieved with the manufacture of cup assembly and sealing elements as separate components. This allows, in conjunction with the rigid support of cup bottom element, the precise locating of the portion of the sealing element which contacts the substrate. Accordingly, because less margin for positioning error is required, sealing elements having reduced radial profiles may be employed, which in turn, allows the sealing element to be designed for contacting the substrate within the cup assembly significantly closer to the substrate's edge, reducing the edge exclusion region during electroplating operations. The combined thinner inner edge of seal element and cup bottom (specifically, its moment arm) will enhance the on-wafer plating performance, e.g., by minimizing/eliminating trapped air bubbles, for example.

System Controllers

In certain embodiments, a system controller is used to control process conditions during sealing the clamshell and/or during processing of the substrate. The system controller will typically include one or more memory devices and one or more processors. The processor may include a CPU or computer, analog and/or digital input/output connections, stepper motor controller boards, etc. Instructions for implementing appropriate control operations are executed on the processor. These instructions may be stored on the memory devices associated with the controller or they may be provided over a network.

In certain embodiments, the system controller controls all of the activities of the processing system. The system controller executes system control software including sets of instructions for controlling the timing of the processing steps listed above and other parameters of a particular process. Other computer programs, scripts or routines stored on memory devices associated with the controller may be employed in some embodiments.

Typically, there is a user interface associated with the system controller. The user interface may include a display screen, graphical software to display process conditions, and user input devices such as pointing devices, keyboards, touch screens, microphones, etc.

The computer program code for controlling the above operations can be written in any conventional computer readable programming language: for example, assembly language, C, C++, Pascal, Fortran or others. Compiled object code or script is executed by the processor to perform the tasks identified in the program.

Signals for monitoring the processes may be provided by analog and/or digital input connections of the system controller. The signals for controlling the processes are output on the analog and digital output connections of the processing system.

Lithographic Patterning

The apparatuses/processes described hereinabove may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility. Lithographic patterning of a film typically comprises some or all of the following steps, each step enabled with a number of possible tools: (1) application of photoresist on a workpiece, i.e., substrate, using a spin-on or spray-on tool; (2) curing of photoresist using a hot plate or furnace or UV curing tool; (3) exposing the photoresist to visible or UV or x-ray light with a tool such as a wafer stepper; (4) developing the resist so as to selectively remove resist and thereby pattern it using a tool such as a wet bench; (5) transferring the resist pattern into an underlying film or workpiece by using a dry or plasma-assisted etching tool; and (6) removing the resist using a tool such as an RF or microwave plasma resist stripper.

OTHER EMBODIMENTS

Although illustrative embodiments and applications of this invention are shown and described herein, many variations and modifications are possible which remain within the concept, scope, and spirit of the invention, and these variations would become clear to those of ordinary skill in the art after perusal of this application. Accordingly, the present embodiments are to be considered as illustrative and not restrictive, and the invention is not to be limited to the details given herein, but may be modified within the scope and equivalents of the appended claims.

We claim:

1. A cup assembly for holding, sealing, and providing electrical power to a semiconductor substrate during electroplating, the cup assembly comprising:

(a) a cup bottom element comprising a main body portion and a radially inwardly protruding moment arm, wherein the main body portion is rigidly affixed to another feature of the cup assembly, and wherein the ratio of the average vertical thickness of the main body portion to the average vertical thickness of the radially inwardly protruding moment arm is greater than about 5, and wherein the ratio of the radial width of the main body portion to the radial width of the radially inwardly protruding moment arm is between about 5 and about 75;

(b) an elastomeric sealing element disposed on the radially inwardly protruding moment arm, wherein elastomeric sealing element is supported by the radially inwardly protruding moment arm, wherein the elastomeric sealing element, when pressed against by the semiconductor substrate, seals against the substrate so as to define a peripheral region of the substrate from which plating solution is substantially excluded during electroplating; and (c) an electrical contact element disposed on the elastomeric sealing element, wherein the electrical contact element contacts the substrate in said peripheral region when the elastomeric sealing element seals against the substrate so that the contact element may provide electrical power to the substrate during electroplating.

2. The cup assembly of claim 1, wherein said peripheral region is substantially radially symmetric and characterized by a first radially inner diameter, wherein the region of contact between the substrate and the electrical contact element is substantially radially symmetric and characterized by a second radially inner diameter, and wherein the second radially inner diameter is larger than the first radially inner diameter.

3. The cup assembly of claim 2, wherein the magnitude of the difference between the first and second radially inner diameters is less than about 0.5 mm.

4. The cup assembly of claim 1, wherein the radially inwardly protruding moment arm of the cup bottom element has a radial width of at most about 0.5 inches.

5. The cup assembly of claim 4, wherein the main body portion of the cup bottom element has an average vertical thickness of at least about 0.2 inches.

6. A cup assembly for holding, sealing, and providing electrical power to a semiconductor substrate during electroplating, the cup assembly comprising:

(a) a cup bottom element comprising a main body portion and a radially inwardly protruding moment arm, wherein the ratio of the radial width of the main body portion to the radial width of the radially inwardly protruding moment arm is between about 5 and about 75;

(b) an elastomeric sealing element disposed on the radially inwardly protruding moment arm, wherein the elastomeric sealing element is supported by the radially inwardly protruding moment arm, wherein the elastomeric sealing element, when pressed against by the semiconductor substrate, seals against the substrate so as to define a peripheral region of the substrate from which plating solution is substantially excluded during electroplating; and (c) an electrical contact element having a substantially flat but flexible contact portion, wherein an entirety of the substantially flat but flexible contact portion is directly disposed upon a substantially horizontal portion of the elastomeric sealing element, wherein the substantially flat but flexible contact portion contacts the substrate in said peripheral region and deforms when pressed upon by the substrate when the elastomeric sealing element seals against the substrate so that the contact element may provide electrical power to the substrate during electroplating.

7. The cup assembly of claim 6, wherein the elastomeric sealing element has a radial width of about 0.5 inches or less.

8. The cup assembly of claim 7, wherein the elastomeric sealing element has a vertical thickness of between about 0.005 and 0.050 inches.

9. The cup assembly of claim 7, wherein the substantially flat but flexible contact portion of the electrical contact element has a radial width of between about 0.01 and 0.5 inches.

10. The cup assembly of claim 6, wherein the substantially flat but flexible contact portion of the electrical contact element is configured to conform to a portion of the shape of the substrate, the conforming facilitated by a spring-like counter-force resulting from compression of the elastomeric sealing element upon which the contact element is disposed.

11. The cup assembly of claim 10, wherein the conforming of the contact element to the shape of the substrate includes conforming to a portion of the profile of the substrate's edge bevel region.

12. The cup assembly of claim 6, wherein the elastomeric sealing element has an upward protrusion which contacts and seals the semiconductor substrate when the substrate is pressed against the elastomeric sealing element, wherein said upward protrusion is radially inward of the substantially horizontal portion of the elastomeric sealing element upon which the electrical contact element is disposed.

13. The cup assembly of claim 12, wherein said upward protrusion of the elastomeric sealing element compresses when sealing against the substrate, wherein said compression enables contact between the substrate and the electrical contact element, and wherein before compression, said upward protrusion of the elastomeric sealing element is vertically above said substantially horizontal portion of the elastomeric sealing element.

14. The cup assembly of claim 6, wherein the electrical contact element comprises a sheet of flexible metal.

15. The cup assembly of claim 14, wherein the flexible metal is a palladium-silver alloy.

16. The cup assembly of claim 14, wherein the flexible metal comprises palladium, silver, gold, and platinum.

17. The cup assembly of claim 14, wherein the flexible metal comprises platinum.

18. The cup assembly of claim 14, wherein the flexible metal comprises stainless-steel.

19. The cup assembly of claim 14, wherein the sheet of flexible metal is about 0.005 inches thick or less.

20. A cup assembly for holding, sealing, and providing electrical power to a semiconductor substrate during electroplating, the cup assembly comprising:

(a) a cup bottom element comprising a main body portion and a radially inwardly protruding moment arm, wherein the main body portion is rigidly affixed to another feature of the cup assembly, and wherein the ratio of the radial width of the main body portion to the radial width of the radially inwardly protruding moment arm between about 5 and about 75;

(b) an elastomeric sealing element integrated with the cup bottom element such that the elastomeric sealing element is disposed on the radially inwardly protruding moment arm and supported by the radially inwardly protruding moment arm, wherein the elastomeric sealing element, when pressed against by the semiconductor substrate, seals against the substrate so as to define a peripheral region of the substrate from which plating solution is substantially excluded during electroplating; and (c) an electrical contact element disposed on the elastomeric sealing element, wherein the electrical contact element contacts the substrate in said peripheral region when the elastomeric sealing element seals against the substrate so that the contact element may provide electrical power to the substrate during electroplating.

21. The cup assembly of claim 20, wherein the elastomeric sealing element is molded and affixed to the radially inwardly protruding moment arm of the cup bottom element.

22. The cup assembly of claim 20, wherein the elastomeric sealing element is molded directly into the radially inwardly protruding moment arm of the cup bottom element.

* * * * *